US010290256B2

(12) United States Patent
Kobayashi

(10) Patent No.: US 10,290,256 B2
(45) Date of Patent: May 14, 2019

(54) FIELD-SEQUENTIAL IMAGE DISPLAY DEVICE AND IMAGE DISPLAY METHOD

(71) Applicant: Sharp Kabushiki Kaisha, Sakai, Osaka (JP)

(72) Inventor: Masamitsu Kobayashi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 25 days.

(21) Appl. No.: 15/523,621

(22) PCT Filed: Aug. 25, 2015

(86) PCT No.: PCT/JP2015/073795

§ 371 (c)(1),
(2) Date: May 1, 2017

(87) PCT Pub. No.: WO2016/072129

PCT Pub. Date: May 12, 2016

(65) Prior Publication Data

US 2017/0330501 A1 Nov. 16, 2017

(30) Foreign Application Priority Data

Nov. 5, 2014 (JP) ..... 2014-225223

(51) Int. Cl.
*G09G 3/20* (2006.01)
*G09G 3/36* (2006.01)
*G09G 3/34* (2006.01)

(52) U.S. Cl.
CPC ..... *G09G 3/2022* (2013.01); *G09G 3/2003* (2013.01); *G09G 3/3406* (2013.01); (Continued)

(58) Field of Classification Search
CPC ..... G09G 2310/0235; G09G 3/2022; G09G 3/2003; G09G 3/3406; G09G 3/3648; G09G 2320/0242; G09G 2320/0247
See application file for complete search history.

(56) References Cited

U.S. PATENT DOCUMENTS

2002/0191104 A1* 12/2002 Matsutani ..... H04N 9/646 348/441
2003/0011614 A1* 1/2003 Itoh ..... G09G 3/2018 345/589

(Continued)

FOREIGN PATENT DOCUMENTS

JP 2002-318564 A 10/2002
JP 2003-140617 A 5/2003

(Continued)

*Primary Examiner* — Lixi C Simpson
(74) *Attorney, Agent, or Firm* — ScienBiziP, P.C.

(57) ABSTRACT

A subframe data generation unit 12 generates brightness data Ew, Er, Eg, Eb of four colors by obtaining distributed brightness with regard to each pixel based on brightness data Dr, Dg, Db of three colors, the distributed brightness being brightness of a white subframe, and obtaining brightness of red, green, and blue subframes with regard to each pixel based on the brightness data Dr, Dg, Db of three colors and the distributed brightness. The subframe data generation unit 12 obtains the distributed brightness by setting an initial value of the distributed brightness to a maximum value that the distributed brightness can take, and then performing adjustment processing for reducing a difference between the distributed brightness of adjacent pixels. With this, a flicker phenomenon occurring at an edge portion of a display image is suppressed.

5 Claims, 23 Drawing Sheets

(52) U.S. Cl.
CPC ... *G09G 3/3648* (2013.01); *G09G 2310/0235* (2013.01); *G09G 2310/08* (2013.01); *G09G 2320/0242* (2013.01); *G09G 2320/0247* (2013.01); *G09G 2320/064* (2013.01); *G09G 2360/16* (2013.01)

(56) References Cited

U.S. PATENT DOCUMENTS

| | | | | |
|---|---|---|---|---|
| 2007/0046914 | A1* | 3/2007 | Lee | G09G 3/3413 355/51 |
| 2007/0132680 | A1* | 6/2007 | Kagawa | G09G 3/3406 345/84 |
| 2012/0062584 | A1* | 3/2012 | Furukawa | H04N 9/3111 345/589 |

FOREIGN PATENT DOCUMENTS

| | | | |
|---|---|---|---|
| JP | 2003-241714 | A | 8/2003 |
| JP | 2003-248462 | A | 9/2003 |
| JP | 2006-293095 | A | 10/2006 |
| WO | 2015/129102 | A1 | 9/2015 |

* cited by examiner

FIELD-SEQUENTIAL IMAGE DISPLAY DEVICE AND IMAGE DISPLAY METHOD

TECHNICAL FIELD

The present invention relates to an image display device, and more specifically relates to a field-sequential image display device and a field-sequential image display method.

BACKGROUND ART

There has been known a field-sequential image display device for displaying a plurality of subframes in one frame period. For example, a typical field-sequential image display device is provided with a backlight including red, green, and blue light sources, and displays red, green, and blue subframes in one frame period. When the red subframe is to be displayed, a display panel is driven based on red video data, and the red light source emits light. Subsequently, the green subframe and the blue subframe are displayed in a similar manner. The three subframes displayed in a time-division manner are synthesized on retinas of an observer by an afterimage phenomenon, and recognized as one color image by the observer.

In the field-sequential image display device, when a line of sight of the observer moves within a display screen, the observer may see the colors of the respective subframes separate from each other (this phenomenon is called color breakup). As a method for suppressing the color breakup, there is known a method of displaying at least one color component of red, green and blue in two or more subframes in one frame period. For example, in a field-sequential image display device for displaying white, red, green, and blue subframes in one frame period, the red color component is displayed in the red and white subframes, the green color component is displayed in the green and white subframes, and the blue color component is displayed in the blue and white subframes.

In relation to the present invention, the following techniques have been known. Patent Document 1 describes that in a field-sequential image display device for displaying white, red, green, and blue subframes in one frame period, a display gradation level which is lower than the lowest value of the display gradation levels of red, green, and blue pixel data is defined as white pixel data, and the white pixel data is subtracted from the red, green, and blue pixel data.

Patent Document 2 describes that in a field-sequential display device for displaying at least each one of an in-between color subfield that displays in-between color video and a three primary color subfield that displays red, green, or blue video in one frame period, the in-between color video is displayed both in the in-between color subfield and the three primary color subfield. Patent Document 2 further describes that in a field-sequential display device for displaying at least each one of a three primary color subfield that displays red, green, or blue video, an in-between color subfield that displays in-between color video, and an achromatic color subfield that displays achromatic color video in one frame period, brightness of a video signal is distributed preferentially in the order of the achromatic color subfield, the in-between color subfield, and the three primary color subfield.

Patent Document 3 describes that in a field-sequential liquid crystal display device for displaying white, red, green, and blue subframes in one frame period, gradation of white is determined from gradation of red, green, and blue, brightness of four colors is calculated from the gradation of four colors, the brightness of red, green, and blue is determined based on the brightness of white, and the gradation of red, green, and blue is calculated from the brightness of red, green, and blue.

PRIOR ART DOCUMENTS

Patent Documents

[Patent Document 1] Japanese Laid-Open Patent Publication No. 2002-318564

[Patent Document 2] Japanese Laid-Open Patent Publication No. 2003-241714

[Patent Document 3] Japanese Laid-Open Patent Publication No. 2006-293095

SUMMARY OF THE INVENTION

Problems to be Solved by the Invention

In the following, a field-sequential liquid crystal display device for displaying white, blue, green, and red subframes in one frame period (hereinafter, referred to as a WBGR system liquid crystal display device) is considered. According to the WBGR system liquid crystal display device, the color breakup can be suppressed by displaying the white subframe. The WBGR system liquid crystal display device obtains brightness of the subframes of four colors based on video data of three colors. At this time, the brightness of the white subframe can be determined within a range from 0 to the minimum value of the red, green, and blue video data. Hereinafter, a ratio of the brightness of the white subframe with respect to the maximum value that the brightness of the white subframe can take is referred to as a distribution ratio. The distribution ratio takes a value not less than 0 and not more than 1.

In the field-sequential liquid crystal display device, an irregular flicker (hereinafter referred to as a flicker phenomenon) occurs at an edge portion of a display image. The flicker phenomenon is easily recognized in a case where, although adjacent pixels have display colors close to each other (color difference or brightness difference is small), subframes used for display are different between the pixels (for example, a case where the same subframe is not used at all, a case where the same subframe is used and the brightness difference is large, and the like). For example, in a field-sequential liquid crystal display device for displaying red, green, and blue subframes in one frame period, when chrominance of each RGB color is large to some extent, the flicker phenomenon is not recognized almost at all because the above condition is hard to be satisfied. On the contrary, in the WBGR system liquid crystal display device or the like, since colors having display colors close to each other (colors having display brightness close to each other), such as white and yellow, are displayed without using the same subframe (white is displayed using the white subframe, and yellow is displayed using the red subframe and the green subframe), the flicker phenomenon is strongly recognized. Thus, as a method for suppressing the flicker phenomenon in the WBGR system liquid crystal display device, there can be considered a method in which the distribution ratio is brought closer to 0, as it becomes closer to the edge portion of the display image. According to this method, the flicker phenomenon occurring at the edge portion of the display image can be suppressed. However, this method has a problem that a color breakup suppressing effect is small at the edge portion of the display image.

Furthermore, When the distribution ratio changes in the display screen, gradation changes with respect to each pixel and with respect to each subframe. Thus, when the same color is to be displayed, the display color may be shifted being affected by response speed of liquid crystal (hereinafter, this phenomenon is referred to as color shift). In the above-described method, the color shift occurs easily because the distribution ratio takes a value not less than 0 and not more than 1 in accordance with a distance from the edge portion of the display image.

Accordingly, it is an object of the present invention to provide a field-sequential image display device for suppressing the flicker phenomenon occurring at the edge portion of the display image.

Means for Solving the Problems

According to a first aspect of the present invention, there is provided a field-sequential image display device including: a subframe data generation unit configured to generate output brightness data corresponding to a plurality of subframes based on input brightness data corresponding to a plurality of color components; and a display unit configured to display the plurality of subframes in one frame period in accordance with a video signal based on the output brightness data, wherein the subframe data generation unit is configured to generate the output brightness data by obtaining distributed brightness with regard to each pixel based on the input brightness data, the distributed brightness being brightness of one or more subframes included in the plurality of subframes, and obtaining brightness of remaining subframes included in the plurality of subframes with regard to each pixel based on the input brightness data and the distributed brightness, and the subframe data generation unit is configured to obtain the distributed brightness by setting an initial value of the distributed brightness to a maximum value that the distributed brightness can take, and then performing adjustment processing for reducing a difference between the distributed brightness of adjacent pixels.

According to a second aspect of the present invention, in the first aspect of the present invention, the subframe data generation unit is configured to perform, with regard to each pixel P as the adjustment processing, processing for setting a value Qi to $(Dsp-Dsi)\times Fi$ when Dsp is not less than Dsi, setting the value Qi to 0 otherwise, and subtracting a maximum value of Qi from Dsp, when Dsp is a maximum value that the distributed brightness of the pixel P can take, Dsi is a maximum value that the distributed brightness of a neighboring pixel Pi can take, and Fi is a coefficient related to the neighboring pixel Pi.

According to a third aspect of the present invention, in the first aspect of the present invention, the subframe data generation unit is configured to perform, as the adjustment processing, processing for applying a low-pass filter to a maximum value that the distributed brightness can take.

According to a fourth aspect of the present invention, in the first aspect of the present invention, the subframe data generation unit is configured to obtain, with regard to each pixel, an evaluation value related to flicker strength based on brightness of the pixel and brightness of neighboring pixels, and perform the adjustment processing based on the evaluation value.

According to a fifth aspect of the present invention, in the fourth aspect of the present invention, the subframe data generation unit is configured to perform, with regard to each pixel P as the adjustment processing, processing for setting a value Qi to $(Dsp-Dsi)\times Hi\times Fi$ when Dsp is not less than Dsi, setting the value Qi to 0 otherwise, and subtracting a maximum value of Qi from Dsp, when Dsp is a maximum value that the distributed brightness of the pixel P can take, Dsi is a maximum value that the distributed brightness of a neighboring pixel Pi can take, Fi is a coefficient related to the neighboring pixel Pi, and Hi is the evaluation value related to the neighboring pixel Pi.

According to a sixth aspect of the present invention, in the second or fifth aspect of the present invention, the coefficient Fi becomes smaller, as a distance between the pixel P and the neighboring pixel Pi becomes larger.

According to a seventh aspect of the present invention, in the first aspect of the present invention, the subframe data generation unit is configured to perform, on the distributed brightness, processing for moving the output brightness data in a predetermined target range.

According to an eighth aspect of the present invention, in the first aspect of the present invention, the plurality of subframes includes a variable color subframe of which color is selectable, and the subframe data generation unit is configured to determine the color of the variable color sublime based on the input brightness data.

According to a ninth aspect of the present invention, in the first aspect of the present invention, the subframe data generation unit is configured to smooth the distributed brightness in a time axial direction.

According to a tenth aspect of the present invention, in the first aspect of the present invention, the subframe data generation unit is configured to obtain the distributed brightness so that a display color based on the input brightness data and a display color based on the output brightness data are identical.

According to an eleventh aspect of the present invention, in the first aspect of the present invention, the image display device further includes: a gradation/brightness conversion unit configured to convert input gradation data to the input brightness data; and a brightness/gradation conversion unit configured to convert the output brightness data to output gradation data, wherein the video signal is based on the output gradation data.

According to a twelfth aspect of the present invention, there is provided a field-sequential image display method including: a step of generating output brightness data corresponding to a plurality of subframes based on input brightness data corresponding to a plurality of color components; and a step of displaying the plurality of subframes in one frame period in accordance with a video signal based on the output brightness data, wherein in the step of generating, the output brightness data is generated by obtaining distributed brightness with regard to each pixel based on the input brightness data, the distributed brightness being brightness of one or more subframes included in the plurality of subframes, and obtaining brightness of remaining subframes included in the plurality of subtropics with regard to each pixel based on the input brightness data and the distributed brightness, and in the step of generating, the distributed brightness is obtained by setting an initial value of the distributed brightness to a maximum value that the distributed brightness can take, and then performing adjustment processing for reducing a difference between the distributed brightness of adjacent pixels.

Effects of the Invention

According to the first or twelfth aspect of the present invention, the distributed brightness is obtained by setting the distributed brightness to the maximum value that the distributed brightness can take, and then performing the adjustment processing for reducing the difference between the distributed brightness of the adjacent pixels. It is possible to suppress the flicker phenomenon occurring at the edge portion of the display image while preventing the color breakup, by generating the output brightness data based on the obtained distributed brightness.

According to the second aspect of the present invention, it is possible to reduce the difference between the distributed brightness of the adjacent pixels by bringing the distributed brightness of the pixel close to the distributed brightness of the neighboring pixel.

According to the third aspect of the present invention, it is possible to reduce the difference between the distributed brightness of the adjacent pixels by applying the low-pass filter to the maximum value that the distributed brightness can take.

According to the fourth aspect of the present invention, it is possible to reduce the difference between the distributed brightness of the adjacent pixels by bringing the distributed brightness of the pixel close to the distributed brightness of the neighboring pixel. Furthermore, it is possible to suppress the flicker phenomenon in a portion where the flicker phenomenon occurs and reduce the color breakup in a portion where the flicker phenomenon does not occur, by performing the adjustment processing based on the evaluation value related to the flicker strength.

According to the fifth aspect of the present invention, it is possible to reduce the difference between the distributed brightness of the adjacent pixels only in a portion where the flicker phenomenon occurs, by bringing the distributed brightness of the pixel close to the distributed brightness of the neighboring pixel based on the evaluation value related to the flicker strength.

According to the sixth aspect of the present invention, it is possible to obtain the distributed brightness considering the distance between the pixel and the neighboring pixel by using the coefficient which becomes smaller as the distance between the pixel and the neighboring pixel becomes larger.

According to the seventh aspect of the present invention, it is possible to prevent using a high gradation and a low gradation with which the color shift occurs easily and prevent the color shift, by performing processing on the distributed brightness, the processing for moving the output brightness data in the target range.

According to the eighth aspect of the present invention, it is possible to suppress the flicker phenomenon occurring at the edge portion of the display image while preventing the color breakup in the field-sequential image display device in which the color of the subframe is selectable.

According to the ninth aspect of the present invention, it is possible to prevent abrupt change of the distributed brightness and prevent degradation of image quality accompanied by abrupt shift of the display color, by smoothing the distributed brightness in the time axial direction.

According to the tenth aspect of the present invention, the image to be displayed can be displayed correctly by obtaining the distributed brightness so that the display color based on the input brightness data and the display color based on the output brightness data are identical.

According to the eleventh aspect of the present invention, even when the input gradation data is input from the outside and the display unit has a nonlinear characteristic, it is possible to suppress the flicker phenomenon occurring at the edge portion of the display image while preventing the color breakup by using the gradation/brightness conversion unit and the brightness/gradation conversion unit.

MODES FOR CARRYING OUT THE INVENTION (First Embodiment)

Figure 1:
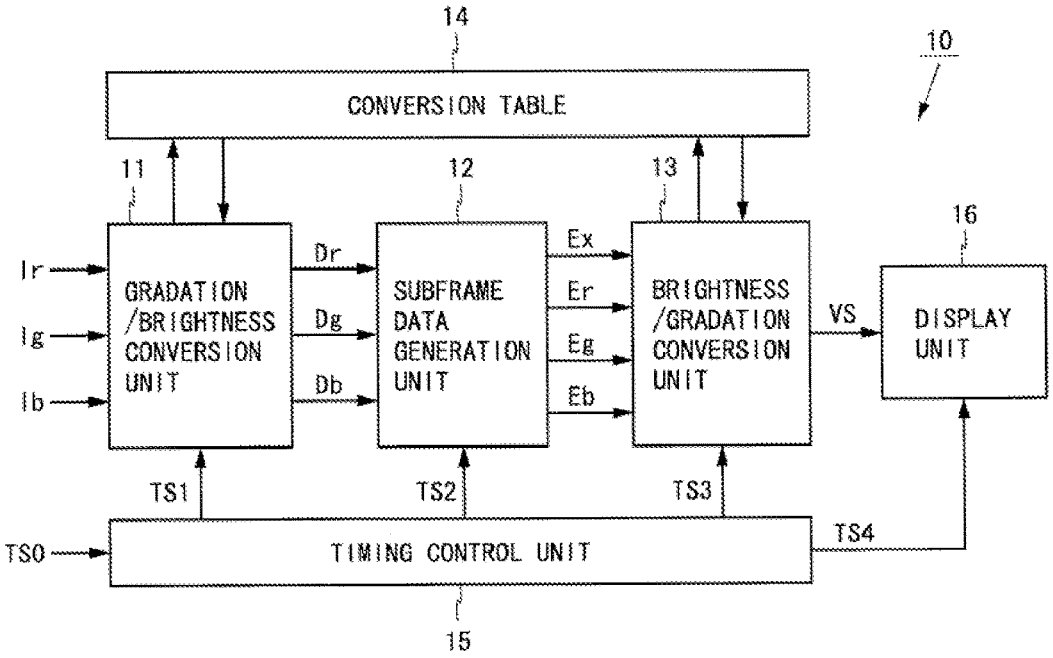
FIG. 1 is a block diagram showing a configuration of an image display device according to a first embodiment of the present invention.

FIG. 1 is a block diagram showing a configuration of an image display device according to a first embodiment of the present invention. An image display device 10 shown in FIG. 1 includes a gradation/brightness conversion unit 11, a subframe data generation unit 12, a brightness/gradation conversion unit 13, a conversion table 14, a timing control unit 15, and a display unit 16. The image display device 10 is a field-sequential image display device for displaying four subframes (white, blue, green, and red subframes) in one frame period. In the image display device 10, one frame period is divided into four subframe periods (white, blue, green, and red subframe periods).

As shown in FIG. 1, input gradation data corresponding to color components of three colors is input from the outside into the image display device 10. The input gradation data includes red gradation data Ir, green gradation data Ig, and blue gradation data Ib. The input gradation data represents gradation of each pixel.

The gradation/brightness conversion unit 11 performs inverse-gamma conversion to convert the input gradation data to input brightness data. The input brightness data represents brightness of each pixel. The gradation/brightness conversion unit 11 converts the red gradation data Ir, the green gradation data Ig, and the blue gradation data Ib respectively to red brightness data Dr, green brightness data Dg, and blue brightness data Db. Hereinafter, it is assumed that the brightness represented by each of the red brightness data Dr, the green brightness data Dg, and the blue brightness data Db is regulated with the maximum brightness being 1.

The subframe data generation unit 12 generates output brightness data corresponding to the subframes of four colors based on the input brightness data corresponding to the three color components. The output brightness data represents brightness of each pixel. The subframe data generation unit 12 generates brightness data Ew, Er, Eg, Eb of four colors based on the brightness data Dr, Dg, Db of three colors.

The brightness/gradation conversion unit 13 performs gamma conversion to convert the output brightness data to output gradation data. The output gradation data represents gradation of each pixel. The brightness/gradation conversion unit 13 converts the brightness data Ew, Er, Eg, Eb of four colors respectively to display gradation data of four colors (display gradation data of white, red, green, and blue), and outputs a video signal VS including the display gradation data of four colors.

The conversion table 14 stares data required for inverse-gamma conversion in the gradation/brightness conversion unit 11 and for gamma conversion in the brightness/gradation conversion unit 13. Based on a timing control signal TS0 supplied from the outside of the image display device 10, the timing control unit 15 outputs timing control signals TS1 to TS4 respectively to the gradation/brightness conversion unit 11, the subframe data generation unit 12, the brightness/gradation conversion unit 13, and the display unit 16. The display unit 16 performs field-sequential drive based on the video signal VS and the timing control signal TS4 to display four subframes in one frame period.

Figure 2:
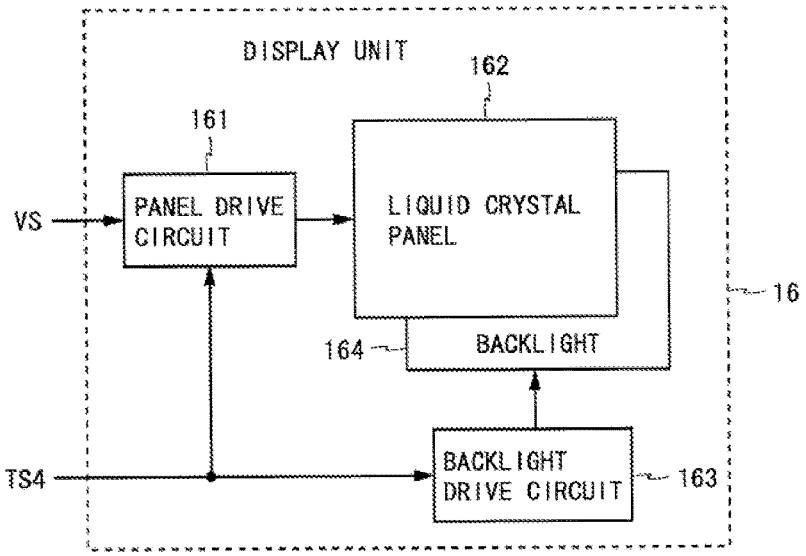
FIG. 2 is a block diagram showing a detail of a display unit shown in FIG. 1.

FIG. 2 is a block diagram showing a detail of the display unit 16. The display unit 16 shown in FIG. 2 includes a panel drive circuit 161, a liquid crystal panel 162, a backlight drive circuit 163, and a backlight 164. The liquid crystal panel 162 includes a plurality of pixels arranged two-dimensionally (not shown). The panel drive circuit 161 drives the liquid crystal panel 162 based on the video signal VS and the timing control signal TS4. The panel drive circuit 161 drives the liquid crystal panel 162 based on the display gradation data of white, blue, green, and red in the white, blue, green, and red subframe periods, respectively.

The backlight 164 includes a red light source, a green light source, and a blue light source (none of which is shown). For the light source of the backlight 164, an LED (Light Emitting Diode) is used, for example. In each subframe period, the backlight drive circuit 163 causes the light source(s) to emit light in accordance with the color of the subframe based on the timing control signal TS4. Specifically, the backlight drive circuit 163 causes the red light source, green light source, and blue light source to emit light in the white subframe period, causes the blue light source to emit light in the blue subframe period, causes the green light source to emit light in the green subframe period, and causes the red light source to emit light in the red subframe period. With this, the white, blue, green, and red subframes are displayed on the liquid crystal panel 162 sequentially in one frame period. Note that the configuration of the display unit 16 is not limited to the configuration shown in FIG. 2.

The blue, green, and red subframes are three basic color subframes, and the white subframe is a non-three basic color subframe. The subframe data generation unit 12 generates the output brightness data Ew, Er, Eg, Eb corresponding to a plurality of subframes including the three basic color subframes and the non-three basic color subframe, based on the input brightness data Dr, Dg, Db corresponding to a plurality of color components. The display unit 16 displays the plurality of subframes in one frame period in accordance with the video signal VS based on the output brightness data Ew, Er, Eg, Eb.

In the image display device 10, brightness of each pixel included in the white brightness data Ew (hereinafter referred to as brightness of the white subframe or distributed brightness) can be determined within a range from 0 to the minimum value of brightness of red, green, and blue. Increasing the brightness of the white subframe can suppress the color breakup, but increases the tendency of the flicker phenomenon to occur at an edge portion of a display image. On the contrary, lowering the brightness of the white subframe can suppress the flicker phenomenon, but increases the tendency of the color breakup to occur. The subframe data generation unit 12 obtains the distributed brightness by the following method in order to suppress the color breakup and the flicker phenomenon.

Figure 3:
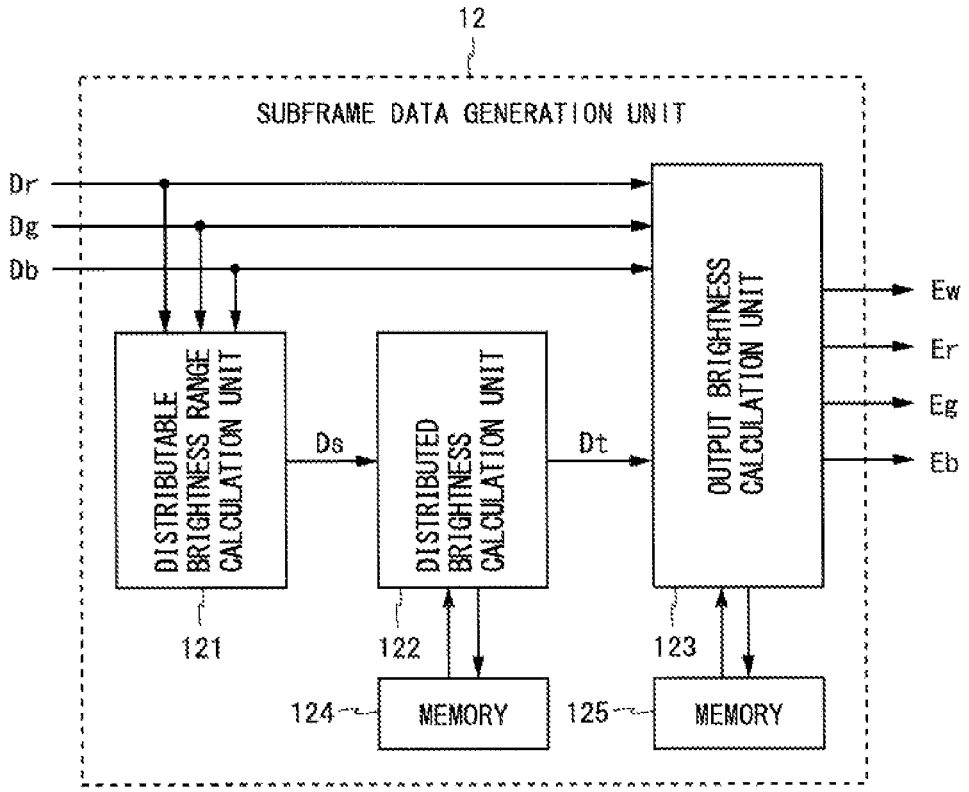
FIG. 3 is a block diagram showing a detail of a subframe data generation unit shown in FIG. 1.

FIG. 3 is a block diagram showing a detail of the subframe data generation unit 12. As shown in FIG. 3, the subframe data generation unit 12 includes a distributable brightness range calculation unit 121, a distributed brightness calculation unit 122, an output brightness calculation unit 123, and memories 124, 125. The subframe data generation unit 12 selects pixels sequentially and performs processing described below on the pixel which is selected. Hereinafter, the pixel which is selected is referred to as a selected pixel, pixels (including the selected pixel) in a neighborhood of the selected pixel are referred to as neighboring pixels, and N is the number of the neighboring pixels. The value of N is 1521 (=39×39), for example.

The memory 124 is a working memory of the distributed brightness calculation unit 122, and the memory 125 is a working memory of the output brightness calculation unit 123. With regard to each pixel included in the input brightness data, the distributable brightness range calculation unit 121 obtains the minimum value of the brightness data Dr, Dg, Db of three colors as maximum distributable brightness, and outputs distributable brightness range data Ds including the obtained maximum distributable brightness. Based on the distributable brightness range data Ds, the distributed brightness calculation unit 122 performs processing for reducing a difference between the distributed brightness of adjacent pixels to obtain the distributed brightness with which the flicker phenomenon can be suppressed, and outputs distributed brightness data Dt including the obtained distributed brightness. The output brightness calculation unit 123 generates the output brightness data based on the input brightness data and the distributed brightness data Dt.

Figure 4:
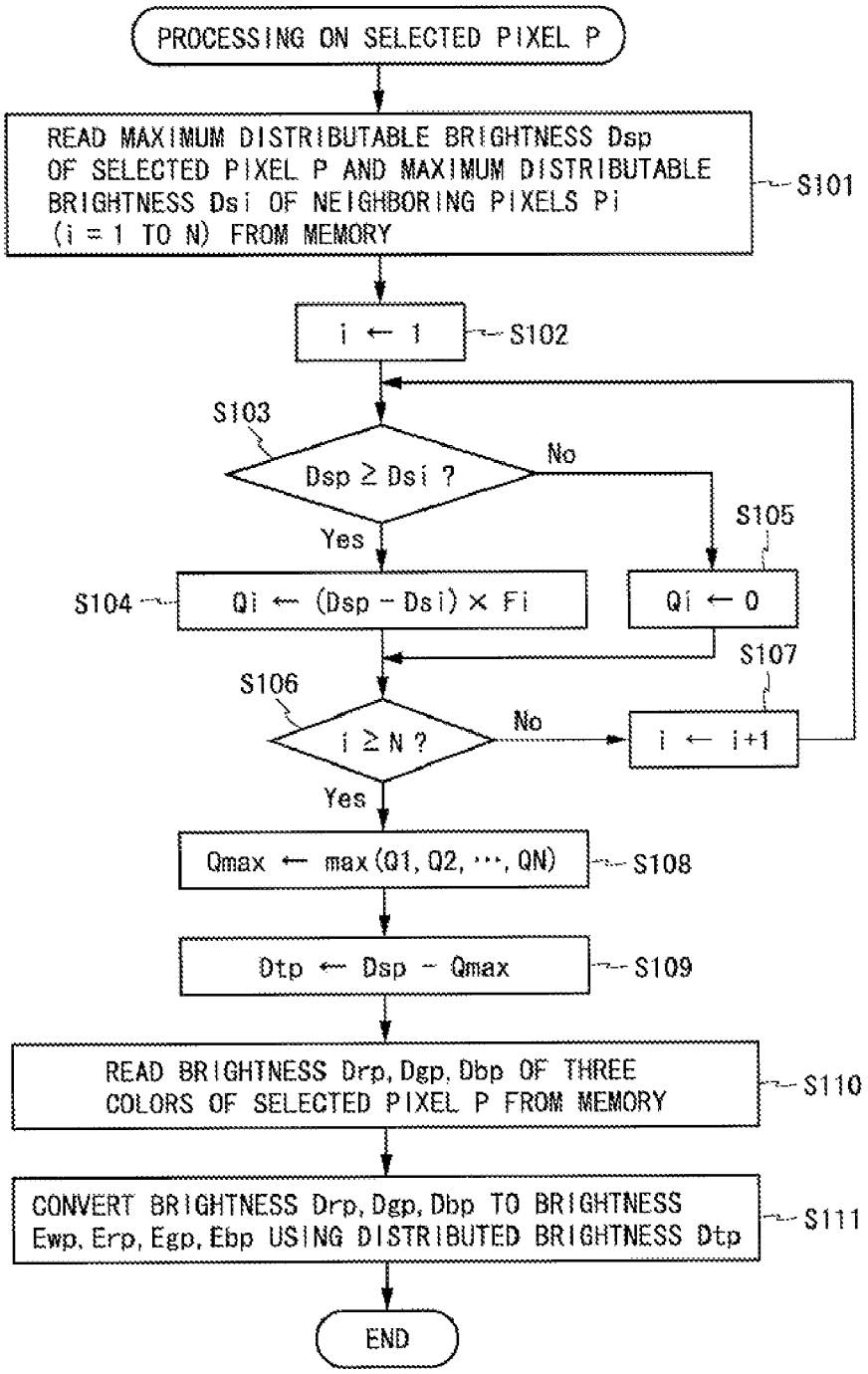
FIG. 4 is a flowchart showing processing performed on a selected pixel in the image display device shown in FIG. 1.

FIG. 4 is a flowchart showing processing performed on the selected pixel by the subframe data generation unit 12. Hereinafter, the selected pixel is denoted by P, the neighboring pixels are denoted by Pi (i=1 to N), brightness of three colors of the selected pixel P is denoted by Drp, Dgp, Dbp, maximum distributable brightness of the selected pixel P is denoted by Dsp, and maximum distributable brightness of the neighboring pixel Pi is denoted by Dsi. Of steps shown in FIG. 4, steps S101 to S109 are performed by the distributed brightness calculation unit 122, and steps S110 and S111 are performed by the output brightness calculation unit 123. The subframe data generation unit 12 may perform steps in parallel, which can be performed in parallel, out of the steps shown in FIG. 4.

Before step S101 is performed, the maximum distributable brightness Dsp of the selected pixel P and the maximum distributable brightness Dsi of the N neighboring pixels Pi are stored in the memory 124. The distributed brightness calculation unit 122 reads the maximum distributable brightness Dsp of the selected pixel P and the maximum distributable brightness Dsi of the N neighboring pixels Pi from the memory 124 (step S101).

Next, the distributed brightness calculation unit 122 substitutes 1 to a variable i (step S102). Next, the distributed brightness calculation unit 122 determines whether the maximum distributable brightness Dsp of the selected pixel P is equal to or more than the maximum distributable brightness Dsi of the neighboring pixel Pi (step S103). When Yes is determined, the distributed brightness calculation unit 122 obtains a value Qi in accordance with the following equation (1) (step S104). When No is determined, the distributed brightness calculation unit 122 sets the value Qi to 0 (step S105).

$$Qi=(Dsp-Dsi)\times Fi \tag{1}$$

In the equation (1), Fi is a filter coefficient.

Figure 5:
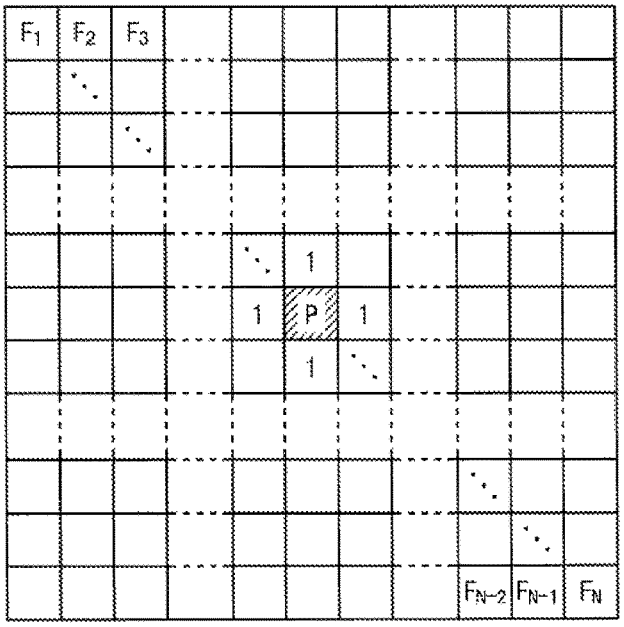
FIG. 5 is a diagram showing filter coefficients used in the image display device shown in FIG. 1.

FIG. 5 is a diagram showing the filter coefficients Fi included in the equation (1). FIG. 5 describes the filter coefficients Fi of the N neighboring pixels Pi arranged two-dimensionally with the selected pixel P (oblique part) as a center. The filter coefficient Fi takes a value not less than 0 and not more than 1. The filter coefficients of four adjacent pixels which are adjacent to the selected pixel P are 1. The filter coefficient Fi is set to a smaller value, as a distance between the selected pixel P and the neighboring pixel Pi becomes larger.

Under a condition that a difference between the filter coefficients corresponding to the adjacent pixels is constant, as the number N of the neighboring pixels becomes larger n other words, as a filter size becomes larger), the difference between the distributed brightness of the adjacent pixels becomes smaller, and the distributed brightness changes more smoothly between the adjacent pixels. Thus, the flicker phenomenon can be suppressed more effectively. On the other hand, flicker strength depends on a distance between an observer and a display screen, a pixel pitch, or the like. It is preferable to determine the number N of the neighboring pixels and the filter coefficients Fi, taking these points into consideration.

Next, the distributed brightness calculation unit 122 determines whether the value of the variable i is equal to or more than N (number of neighboring pixels) (step S106). When No is determined, the distributed brightness calculation unit 122 adds 1 to the variable i (step S107), and goes to step S103. When Yes is determined in step S106, the distributed brightness calculation unit 122 goes to step S108. In this case, the distributed brightness calculation unit 122 obtains the maximum value Qmax of N pieces of the values Qi (step S108). Next, the distributed brightness calculation unit 122 sets the distributed brightness Dtp of the selected pixel P to a value (Dsp−Qmax) obtained by subtracting the maximum value Qmax from the maximum distributable brightness Dsp of the selected pixel P (step S109).

Next, the output brightness calculation unit 123 reads the brightness Drp, Dgp, Dbp of three colors of the selected pixel P from the memory 125 (step S110). Next, the output brightness calculation unit 123 converts the brightness Drp, Dgp, Dbp of three colors of the selected pixel P to brightness Ewp, Erp, Egp, Ebp of four colors, using the distributed brightness Dtp of the selected pixel P (step S111). Specifically, the output brightness calculation unit 123 performs calculation shown in the following equations (2a) to (2d).

$$Ewp=Dtp \tag{2a}$$

$$Erp=Drp-Dtp \tag{2b}$$

$$Egp=Dgp-Dtp \tag{2c}$$

$$Ebp=Dbp-Dtp \tag{2d}$$

When the subframe data generation unit 12 performs processing shown in FIG. 4 on the selected pixel P, a display color based on the input brightness data Dr, Dg, Db and a display color based an the output brightness data Ew, Er, Eg, Eb are identical. In other words, the subframe data generation unit 12 obtains the distributed brightness so that the display color based on the input brightness data Dr, Dg, Db and the display color based on the output brightness data Ew, Er, Eg, Eb are identical. Therefore, according to the image display device 10, an image to be displayed can be displayed correctly.

Figure 6:
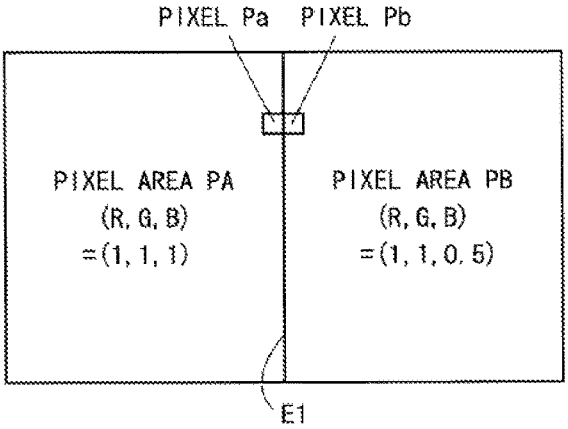
FIG. 6 is a diagram showing two adjacent pixel areas.
Figure 7:
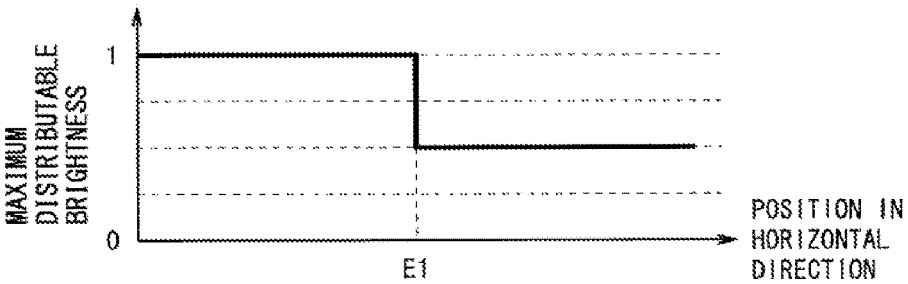
FIG. 7 is a diagram showing maximum distributable brightness of the pixel areas shown in FIG. 6.
Figure 8:
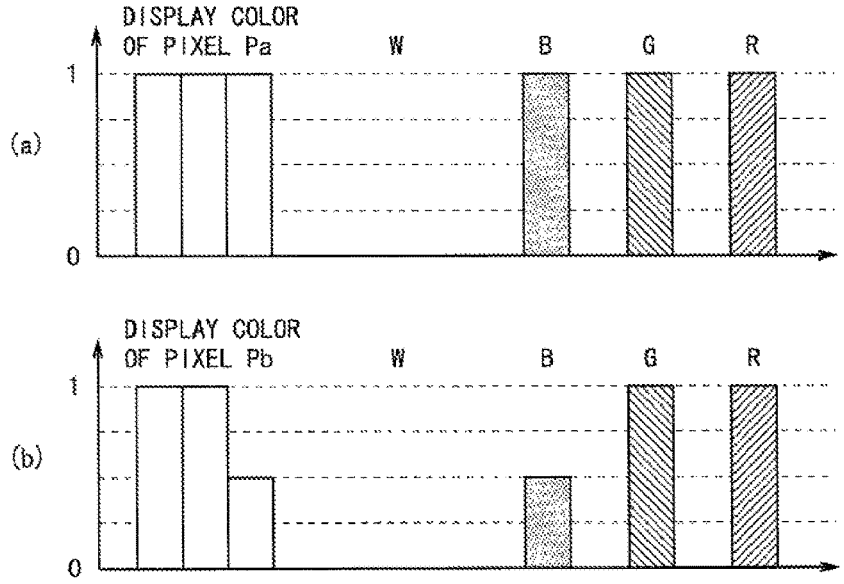
FIG. 8 is a diagram showing a distribution method of brightness in an image display device according a comparative example.

Hereinafter, effects of the image display device 10 according to the present embodiment will be described referring to FIGS. 6 to 11 and comparing with an image display device in which the distributed brightness is brought closer to 0 as it becomes closer to the edge portion of the display image (hereinafter referred to as an image display device according to a comparative example). As an example, two adjacent pixel areas PA, PB shown in FIG. 6 are considered here. It is assumed that a display color of the pixel area PA is white and is represented by (R, G, B)=(1, 1, 1) using color components. It is assumed that a display color of the pixel area PB is light yellow and is represented by (R, G, B)=(1, 1, 0.5) using the color components. A boundary of the pixel areas PA, PB is referred to as an edge E1, a pixel immediately left to the edge E1 (rightmost pixel in the pixel area PA) is referred to as Pa, and a pixel immediately right to the edge E1 (leftmost pixel in the pixel area PB) is referred to as Pb. In this case, the maximum distributable brightness is 1 in the left side of the edge E1, and is 0.5 in the right side of the edge E1 (refer to FIG. 7). The distributable brightness range is from 0 to 1 in the left side of the edge E1, and is from 0 to 0.5 in the right side of the edge E1. When the output brightness data is obtained within the distributable brightness range based on the maximum distributable brightness, a flicker phenomenon (irregular flicker) occurs near the edge E1.

Figure 9:
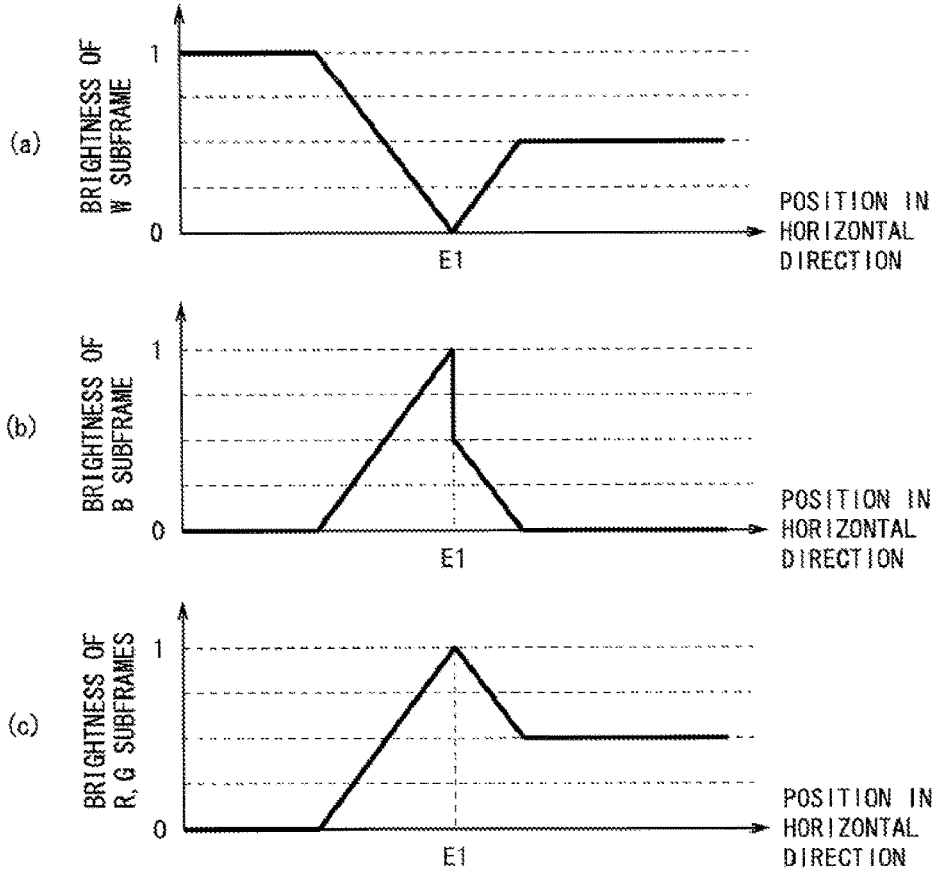
FIG. 9 is a diagram showing brightness in the image display device according to the comparative example.
Figure 10:
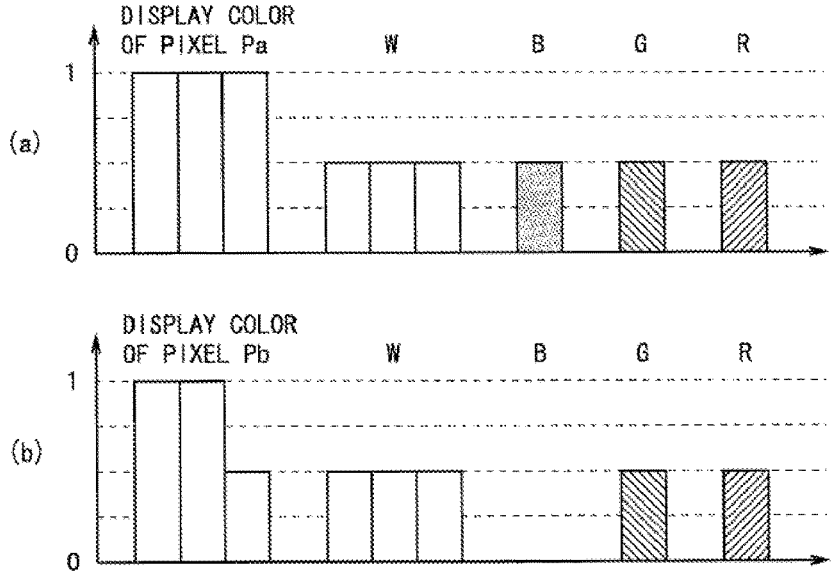
FIG. 10 is a diagram showing a distribution method of brightness in the image display device shown in FIG. 1.

The image display device according to the comparative example sets the distributed brightness smaller as it becomes closer to the edge E1, based on an idea that the distributed brightness (brightness of the white subframe) should be reduced in order to suppress the flicker phenomenon. Thus, the brightness of the pixel Pa in the white subframe is determined to be 0, and accordingly the brightness of the pixel Pa in the blue, green, and red subframes is determined to be 1 (FIG. 8(*a*). The brightness of the pixel Pb in the white subframe is also determined to be 0. Accordingly, the brightness of the pixel Pb in the blue subframe is determined to be 0.5, and the brightness of the pixel Pb in the green and red subframes is determined to be 1 (FIG. 8(*b*)). The brightness of each subframe is determined as shown in FIG. 9(*a*) to (*c*), in accordance with a position in a horizontal direction.

According to the image display device of the comparative example, the flicker phenomenon occurring near the edge E1 can be suppressed by further reducing the distributed brightness as it becomes closer to the edge E1. However, in the image display device according to the comparative example, a color breakup suppressing effect by adding the white subframe is reduced near the edge E1.

Figure 11:
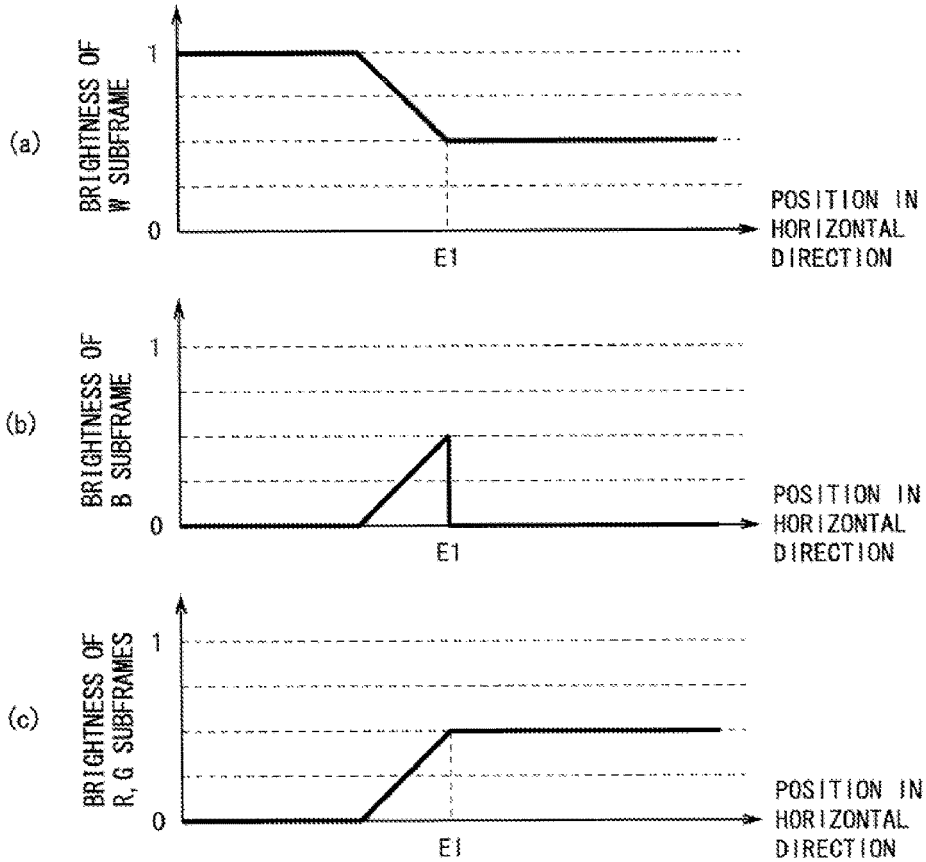
FIG. 11 is a diagram showing brightness in the image display device shown in FIG. 1.

On the contrary, the image display device 10 according to the present embodiment reduces the difference between distributed brightness of adjacent pixels while keeping the distributed brightness as large as possible, based on an idea that the difference between the distributed brightness of adjacent pixels should be reduced in order to suppress the flicker phenomenon. Thus, the brightness of the pixel Pa in the white subframe is determined to be 0.5, and accordingly the brightness of the pixel Pa in the blue, green, and red subframes is determined to be 0.5 (FIG. 10(*a*)). The brightness of the pixel Pb in the white subframe is determined to be 0.5. Accordingly, the brightness of the pixel Pb in the blue subframe is determined to be 0, and the brightness of the pixel Pb in the green and red subframes is determined to be 0.5 (FIG. 10(*b*)). The brightness of each subframe is determined as shown in FIG. 11(*a*) to (*c*) in accordance with the position in the horizontal direction.

Therefore, according to the image display device 10 of the present embodiment, it is possible to suppress the flicker phenomenon occurring near the edge E1 by reducing brightness difference of the adjacent pixels in the white subframe. Moreover, it is possible to make the brightness of the white subframe larger than that in the image display device according to the comparative example and suppress the color breakup. Furthermore, a range in which the brightness of the white subframe changes can be reduced more than that in the image display device according to the comparative example, and the color shift can be suppressed.

As described above, the image display device 10 according to the present embodiment includes the subframe data generation unit 12 for generating the output brightness data Ew, Er, Eg, Eb corresponding to the plurality of subframes (first to fourth subframes) based on the input brightness data Dr, Dg, Db corresponding to the plurality of the color components, and the display unit 16 for displaying the plurality of subframes in one frame period in accordance with the video signal VS based on the output brightness data Ew, Er, Eg, Eb. The subframe data generation unit 12 generates the output brightness data Ew, Er, Eg, Eb by obtaining the distributed brightness with regard to each pixel based on the input brightness data Dr, Dg, Db, the distributed brightness being brightness of one or more subframes (first subframe) included in the plurality of subframes, and obtains the brightness of remaining subframes (second to fourth subframes) included in the plurality of subframes with regard to each pixel based on the input brightness data Dr, Dg, Db and the distributed brightness. The subframe data generation unit 12 obtains the distributed brightness by setting the initial value of the distributed brightness to the maximum value (maximum distributable brightness) that the distributed brightness can take, and then performing adjustment processing (steps S101 to S109) for reducing the difference between the distributed brightness of adjacent pixels. As described, in the image display device 10 according to the present embodiment, the distributed brightness is obtained by setting to the maximum value that can take, and then performing the adjustment processing for reducing the difference between the distributed brightness of the adjacent pixels. Therefore, according to the image display device 10 of the present embodiment, it is possible to suppress the flicker phenomenon occurring at the edge portion of the display image while preventing the color breakup by generating the output brightness data Ew, Er, Eg, Eb based on the obtained distributed brightness.

Furthermore, the subframe data generation unit 12 performs, with regard to each pixel P as the adjustment processing, processing for setting the value Qi to (Dsp−Dsi)×Fi when Dsp is not less than Dsp, setting the value Qi to 0 otherwise, and subtracting the maximum value Qi from Dsp, when Dsp is the maximum value that the distributed brightness of the pixel P can take, Dsi is the maximum value that the distributed brightness of the neighboring pixel Pi can take, and Fi is the coefficient related to the neighboring pixel Pi. By thus bringing the distributed brightness of the pixel close to the distributed brightness of the neighboring pixel, the difference between the distributed brightness of the adjacent pixels can be reduced.

Furthermore, the coefficient Fi becomes smaller, as the distance between the selected pixel P and the neighboring pixel Pi becomes larger. By using the coefficient Fi, the distributed brightness can be obtained considering the distance between the pixel and the neighboring pixel.

Furthermore, the subframe data generation unit 12 obtains the distributed brightness so that the display color based on the input brightness data Dr, Dg, Db and the display color based on the output brightness data Ew, Er, Eg, Eb are identical. Therefore, an image to be displayed can be displayed correctly.

Furthermore, the image display device 10 includes the gradation/brightness conversion unit 11 for converting the input gradation data Ir, Ig, Ib to the input brightness data Dr, Dg, Db, and the brightness/gradation conversion unit 13 for converting the output brightness data Ew, Er, Eg, Eb to the output gradation data. The video signal VS is based on the output gradation data. Therefore, even when the input gradation data is input from the outside, and the display unit has a nonlinear characteristic, it is possible to suppress the flicker phenomenon occurring at the edge portion of the display image while preventing the color breakup, using gradation/brightness conversion unit 11 and the brightness/gradation conversion unit 13.

Note that the method for reducing the difference between the distributed brightness of the adjacent pixels is not limited to the above-described method. For example, the distributed brightness may be obtained by applying a low-pass filter to the maximum value that the distributed brightness can take and then performing processing for correcting the value after applying the low-pass filter to bring in the distributable brightness range, and so on, so that the output color (color displayed actually) is identical to the input color (color to be displayed). Also by this method, it is possible to reduce the brightness difference of the adjacent pixels in the white subframe and suppress the flicker phenomenon to some extent. Furthermore, even in a case where the above-described correction method is not performed and the output color is not identical to the input color (in a case where distributed brightness is not corrected to bring in the distributable brightness range), if an error of the output color compared to the input color falls within an allowable range, the result of applying the low-pass filter to the maximum value that the distributed brightness can take may be used as it is in order to preferentially suppress the flicker phenomenon.

As described, the subframe data generation unit may perform, as the adjustment processing, processing for applying the low-pass filter to the maximum value that the distributed brightness can take. By using the adjustment processing, the difference between the distributed brightness of the adjacent pixels can be reduced.

(Second Embodiment)

Figure 12:
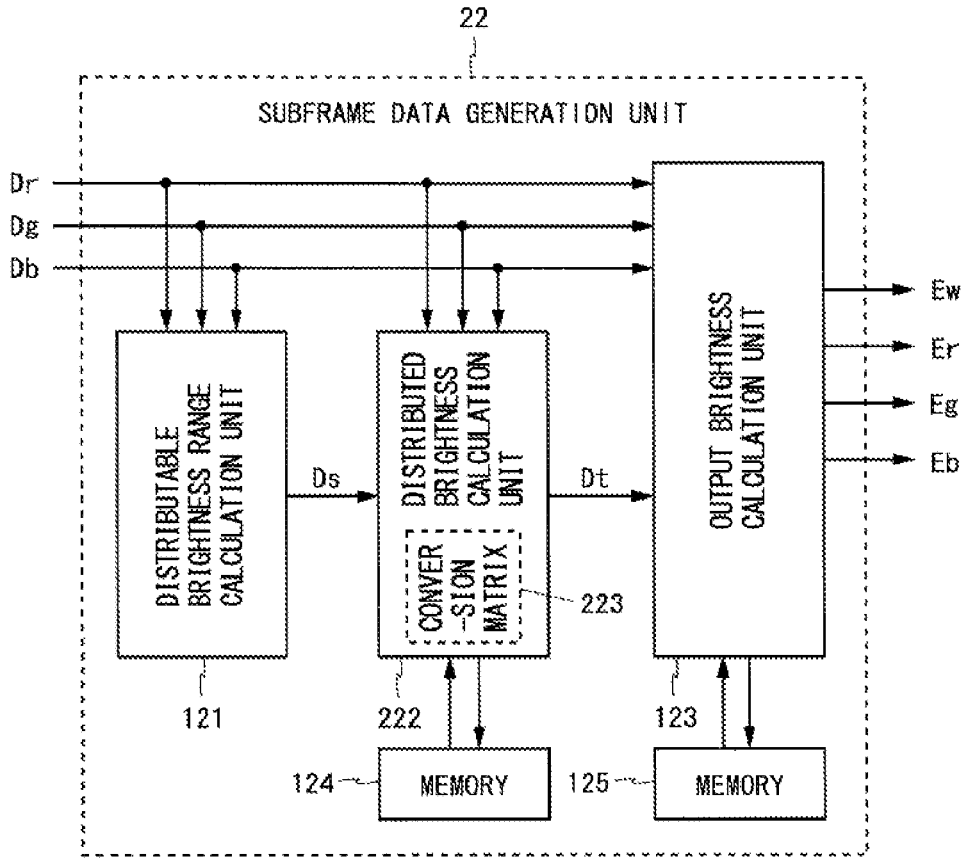
FIG. 12 is a block diagram showing a detail of a subframe data generation unit of an image display device according to a second embodiment of the present invention.

An image display device according to a second embodiment of the present invention is obtained by replacing the subframe data generation unit 12 of the image display device (FIG. 1) according to the first embodiment with a subframe data generation unit 22 shown in FIG. 12. Of the components of the present embodiment, the same components as those of the first embodiment are provided with the same reference numerals and their descriptions are omitted.

FIG. 12 is a block diagram showing a detail of the subframe data generation unit 22. The subframe data generation unit 22 is obtained by replacing the distributed brightness calculation unit 122 in the sublime data generation unit 12 with a distributed brightness calculation unit 222. The distributed brightness calculation unit 222 obtains an evaluation value related to flicker strength, and obtains the distributed brightness using the obtained evaluation value.

Figure 13:
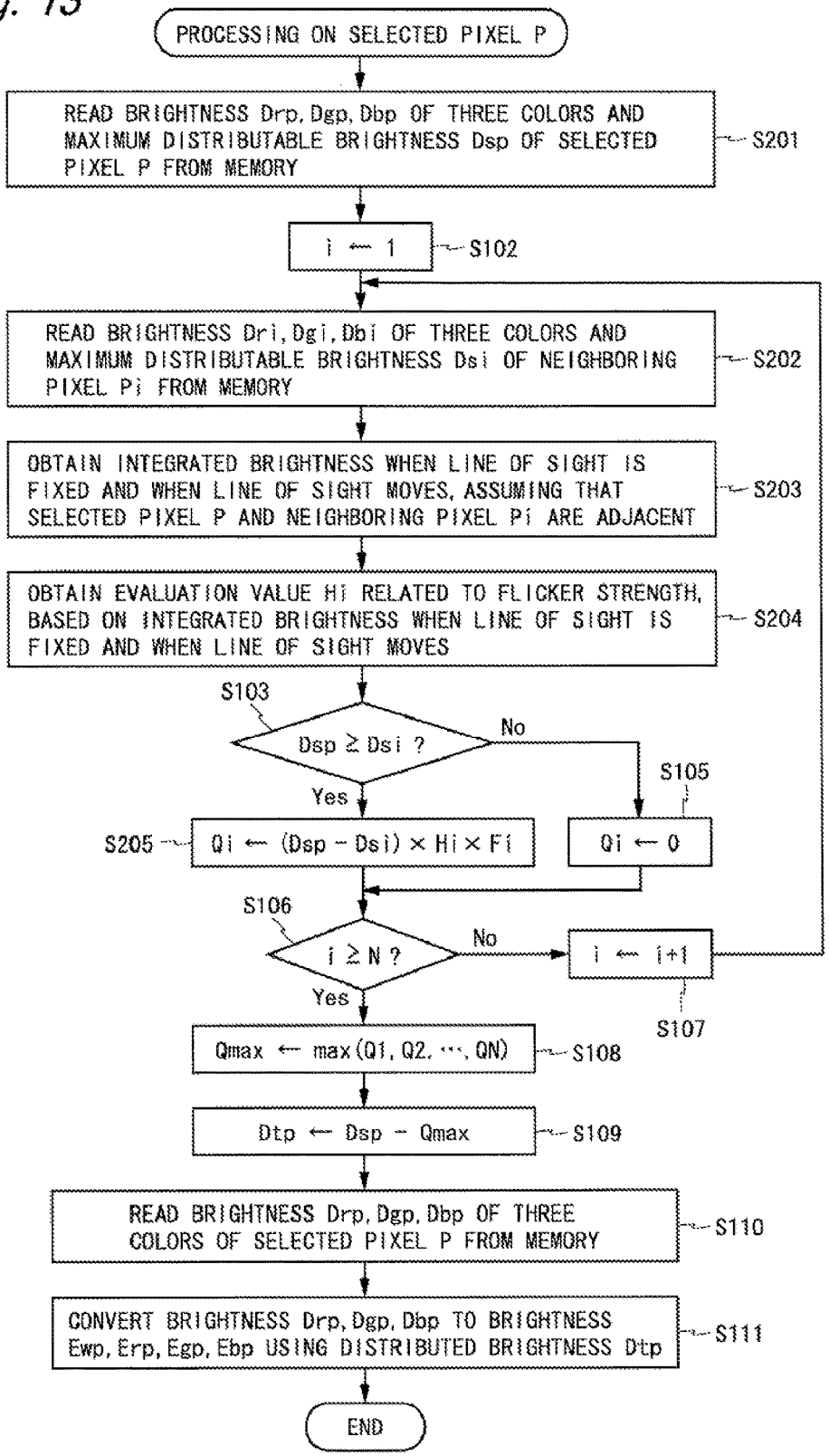
FIG. 13 is a flowchart showing processing performed on a selected pixel in the image display device according to the second embodiment: of the present invention.

FIG. 13 is a flowchart showing processing performed on the selected pixel P by the subframe data generation unit 22. The flowchart shown in FIG. 13 is obtained based on the flowchart shown in FIG. 4 by replacing step S101 with step S201, adding steps S202 to S204 before step S103, and replacing step S104 with step S205. Hereinafter, differences from the first embodiment will be described, with brightness of three colors of the neighboring pixel Pi being denoted by Dri, Dgi, Dbi.

Before step S201 is performed, the brightness Drp, Dgp, Dbp of three colors of the selected pixel P and the brightness Dri, Dgi, Dbi of three colors of the N neighboring pixels Pi are stored in the memory 124, in addition to the maximum distributable brightness Dsp of the selected pixel P and the maximum distributable brightness Dsi of the N neighboring pixels Pi. The distributed brightness calculation unit 222 reads the brightness Drp, Dgp, Dbp of three colors and the maximum distributable brightness Dsp of the selected pixel P from the memory 124 (step S201).

Next, the distributed brightness calculation unit 222 substitutes 1 to a variable i (step S102). Next, the distributed brightness calculation unit 222 reads the brightness Dri, Dgi, Dbi of three colors and the maximum distributable brightness Dsi of the neighboring pixel Pi from the memory 124 (step S202). Next, based on the six kinds of brightness read in steps S201, S202, the distributed brightness calculation unit 222 obtains integrated brightness when a line of sight is fixed and when the line of sight moves, assuming that the selected pixel P and the neighboring pixel Pi are adjacent (step S203). Next, the distributed brightness calculation unit 222 obtains an evaluation value Hi related to flicker strength, based on the integrated brightness when the line of sight is fixed and when the line of sight moves, the integrated brightness obtained in step S203 (step S204). Each of the N evaluation values Hi takes a value not less than 0 and not more than 1. The evaluation value Hi becomes larger, as the flicker phenomenon becomes more easily recognized between the brightness Drp, Dgp, Dbp of three colors and the brightness Dri, Dgi, Dbi of three colors.

Next, the distributed brightness calculation unit 222 performs steps S103, S205, and S105 to S109. In step S205, the distributed brightness calculation unit 222 obtains a value Qi in accordance with the following equation (3).

$$Qi=(Dsp-Dsi)\times Hi\times Fi \tag{3}$$

In the equation (3), Fi is the filter coefficient described in the first embodiment, and Hi is the evaluation value related to the flicker strength obtained in step S204. The value Qi obtained in step S205 is used when the distributed brightness Dtp is obtained in steps S108, S109.

Figure 14:
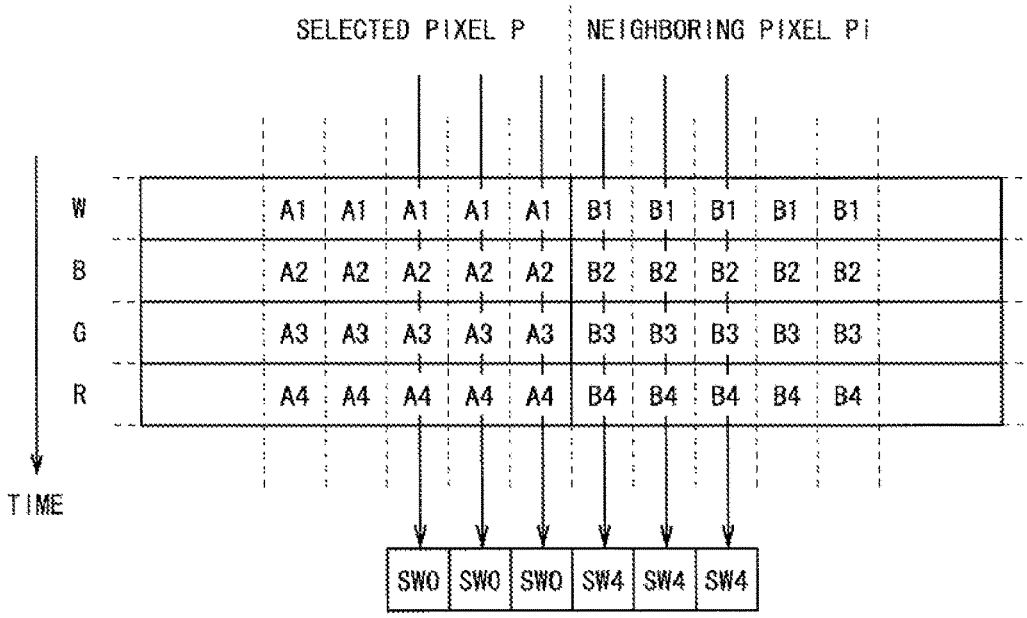
FIG. 14 is a diagram showing a method for calculating integrated brightness when a line of sight of an observer is fixed in the image display device according to the second embodiment of the present invention.
Figure 15:
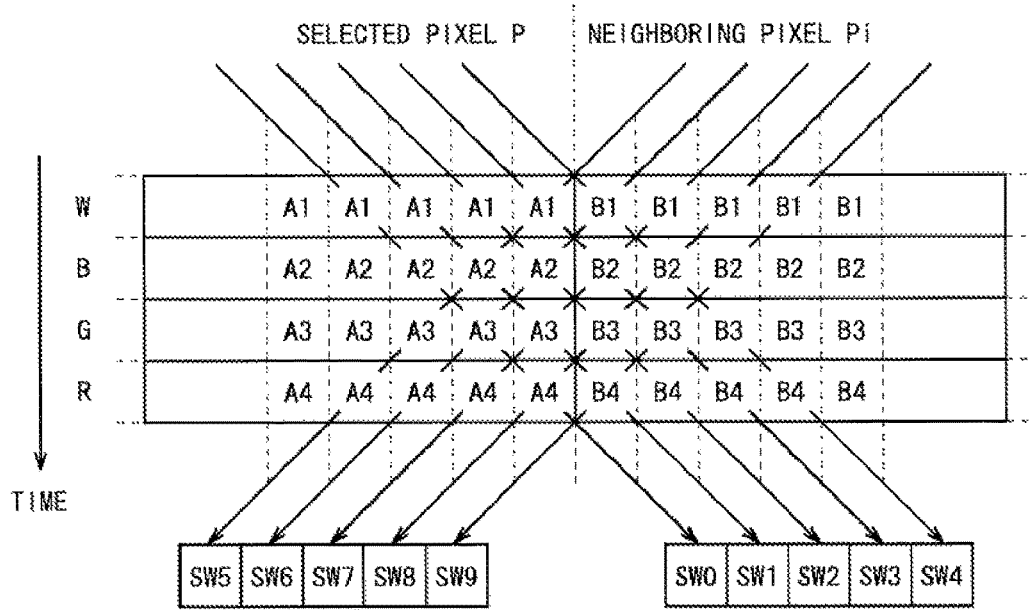
FIG. 15 is a diagram showing a method for calculating the integrated brightness when the line of sight of the observer moves in the image display device according to the second embodiment of the present invention.

Details of step S203 (step for obtaining the integrated brightness when the line of sight is fixed and when the line of sight moves) will be described below referring to FIGS. 14 and 15. FIG. 14 is a diagram showing a method for obtaining the integrated brightness when the line of sight of the observer is fixed. FIG. 15 is a diagram showing a method for obtaining the integrated brightness when the line of sight of the observer moves, taking the white subframe as a start position.

Based on the brightness Drp, Dgp, Dbp of three colors and the maximum distributable brightness Dsp of the selected pixel P, the distributed brightness calculation unit 222 obtains colors A1 to A4 of the first to fourth subframes of the selected pixel P when the maximum distributable brightness is used, in accordance with the following equations (4a) to (4d). Hereinafter, a subframe color may be represented by a vector format including a red component, a green component, and a blue component.

$$A1=(Dsp, Dsp, Dsp) \quad (4a)$$

$$A2=(0, 0, Dbp-Dsp) \quad (4b)$$

$$A3=(0, Dgp-Dsp, 0) \quad (4c)$$

$$A4=(Drp-Dsp, 0, 0) \quad (4d)$$

Based on the brightness Dri, Dgi, Dbi of three colors and the maximum distributable brightness Dsi of the neighboring pixel Pi, the distributed brightness calculation unit 222 obtains colors B1 to B4 of the first to fourth subframes of the neighboring pixel Pi when the maximum distributable brightness is used, in accordance with the following equations (5a) to (5d).

$$B1=(Dsi, Dsi, Dsi) \quad (5a)$$

$$B2=(0, 0, Dbi-Dsi) \quad (5b)$$

$$B3=(0, Dgi-Dsi, 0) \quad (5c)$$

$$B4\ (Dri-Dsi, 0, 0) \quad (5d)$$

The distributed brightness calculation unit 222 obtains integrated brightness SW0 to SW9 when taking the white subframe as the start position, by performing the following calculation (refer to FIGS. 14 and 15).

$$SW0=SW5=A1+A2+A3+A4$$

$$SW4=SW9=B1+B2+B3+B4$$

$$SW1=A1+A2+A3+B4$$

$$SW2=A1+A2+B3+B4$$

$$SW3=A1+B2+B3+B4$$

$$SW6=B1+A2+A3+A4$$

$$SW7=B1+B2+A3+A4$$

$$SW8=B1+B2+B3+A4$$

For example, the integrated brightness SW1 is obtained as follows.

$$SW1=(Dsp+Dri-Dsi, Dgp, Dbp)$$

The distributed brightness calculation unit 222 obtains integrated brightness SB0 to SB9 when taking the blue subframe as the start position, integrated brightness SG0 to SG9 when taking the green subframe as the start position, and integrated brightness SR0 to SR9 when taking the red subframe as the start position, by performing the following calculation.

$$SB0=SB5=SG0=SG5=SR0=SR5=A1+A2+A3+A4$$

$$SB4=SB9=SG4=SG9=SR4=SR9=B1+B2+B3+B4$$

$$SB1=A2+A3+A4+B1$$

$$SB2=A2+A3+B4+B1$$

$$SB3=A2+B3+B4+B1$$

$$SB6=B2+A3+A4+A1$$

$$SB7=B2+B3+A4+A1$$

$$SB8=B2+B3+B4+A1$$

$$SG1=A3+A4+A1+B2$$

$$SG2=A3+A4+B1+B2$$

$$SG3=A3+B4+B1+B2$$

$$SG6=B3+A4+A1+A2$$

$$SG7=B3+B4+A1+A2$$

$$SG8=B3+B4+B1+A2$$

$$SR1=A4+A1+A2+B3$$

$$SR2=A4+A1+B2+B3$$

$$SR3=A4+B1+B2+B3$$

$$SR6=B4+A1+A2+A3$$

$$SR7=B4+B1+A2+A3$$

$$SR8=B4+B1+B2+A3$$

The distributed brightness calculation unit 222 obtains the integrated brightness SW0, SW4, SW5, SW9, SB0, SB4, SB5, SB9, SG0, SG4, SG5, SG9, SR0, SR4, SR5, SR9 when the line of sight is fixed, and the integrated brightness SW1 to SW3, SW6 to SW8, SB1 to SB3, SB6 to SB8, SG1 to SG3, SG6 to SG8, SR1 to SR3, SR6 to SR8 when the line of sight moves, by performing the above calculation in step S203.

Next, details of step S204 (step for obtaining the evaluation value related to the flicker strength) will be described. The flicker strength is large in the following cases, for example. When a color difference is obtained by comparing a color when the line of sight moves and a color when the line of sight is fixed, the flicker strength becomes larger, as a ratio of the obtained color difference with respect to the color when the line of sight is fixed becomes larger. Furthermore, the flicker strength becomes larger, as the color difference between two pixels when the line of sight moves becomes smaller.

Thus, the distributed brightness calculation unit 222 obtains the evaluation value Hi related to the flicker strength in accordance with the following equation (6). When the obtained value is not less than 1, Hi=1. When the obtained value is not more than 0, Hi=0.

$$Hi=K1(\Delta E1/\Delta E2)-K2(\Delta E3/\Delta E2) \quad (6)$$

In the equation (6), ΔE1 represents the maximum value of color difference between a color when the line of sight moves and a color when the line of sight is fixed, ΔE2 represents a color difference between black and the color when the line of sight is fixed in a case where the color difference between the color when the line of sight moves and the color when the line of sight is fixed is at its maximum, ΔE3 represents a color difference of colors of two pixels when the line of sight is fixed, and K1 and K2 represent predetermined coefficients. The coefficients K1, K2 are determined based on an individual difference of the observer related to flicker recognition, a distance between the observer and a display screen, a resolution of the display screen, and the like.

Figure 16:
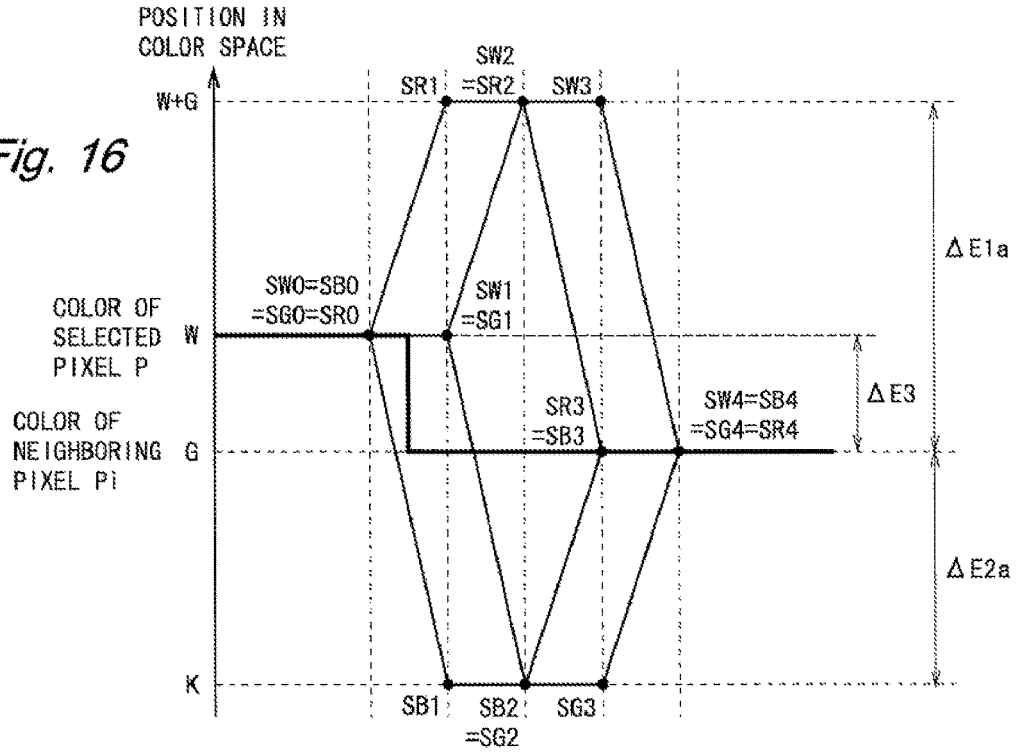
FIG. 16 is a diagram showing a position in a color space corresponding to the integrated brightness when the line of sight of the observer moves in a right direction in the image display device according to the second embodiment of the present invention.
Figure 17:
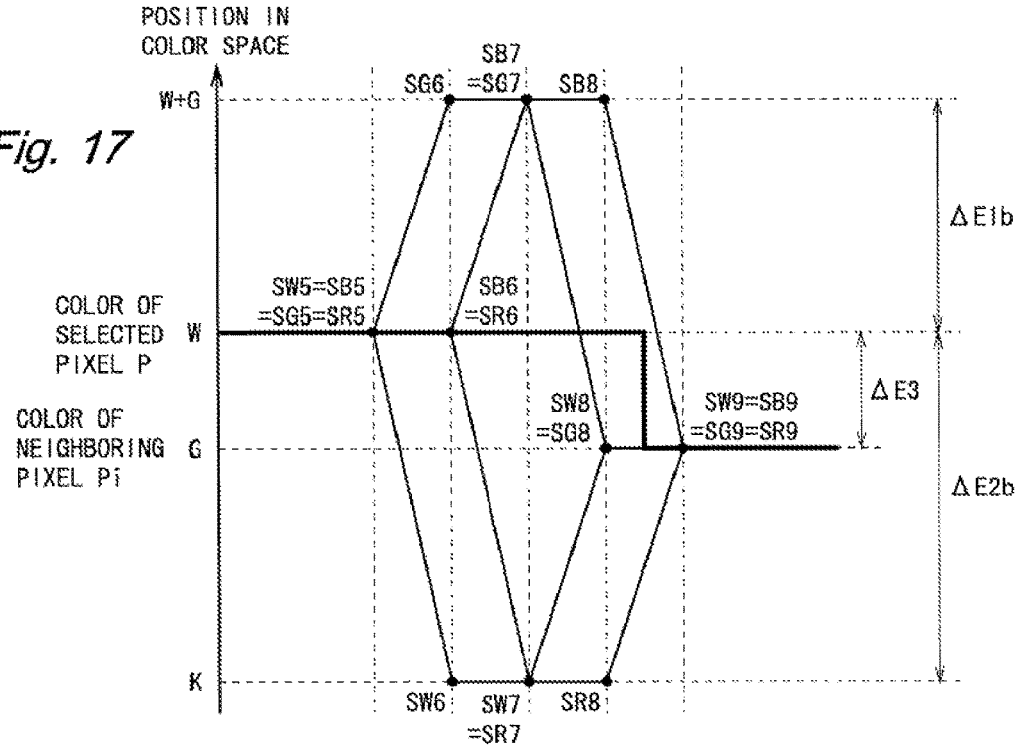
FIG. 17 is a diagram showing a position in the color space corresponding to the integrated brightness when the line of sight of the observer moves in a left direction in the image display device according to the second embodiment of the present invention.

A specific example for obtaining ΔE1 to ΔE3 will be described referring to FIGS. 16 and 17. It is assumed here that a display color of the selected pixel P is white and represented by (R, G, B)=(1, 1, 1) using the color components, and a display color of the neighboring pixel Pi is green and represented by (R, G, B)=(0, 1, 0) using the color components. FIG. 16 is a diagram showing a position in a color space corresponding to the integrated brightness when the line of sight of the observer moves in the right direction. FIG. 17 is a diagram showing the same contents when the line of sight of the observer moves in the left direction. In FIGS. 16 and 17, W represents white, G represents green, and K represents black.

The maximum value ΔE1 of color difference is the maximum value of color difference between the integrated brightness SWk, SRk, SGk, SBk (here, k=1 to 3) and the integrated brightness SW4, and a color difference of the integrated brightness SWk, SRk, SGk, SBk (here, k=6 to 8) and the integrated brightness SW5. In the example shown in FIGS. 16 and 17, the maximum value ΔE1 of the color difference is the maximum value of ΔE1*a*, ΔE1*b*, ΔE2*a*, and ΔE2*b*, that is ΔE1*a*. The color difference ΔE2 is a value corresponding to ΔE1*a* in ΔE2*a* and ΔE2*b*, that is ΔE2*a*. The color difference ΔE3 is a color difference between the integrated brightness SW0 and the integrated brightness SW4 (equals to a color difference between the integrated brightness SW5 and the integrated brightness SW9, and the like).

The distributed brightness calculation unit 222 may obtain a color difference in a CIE (International Commission on Illumination) 1976 L*a*b* display system, may obtain a color difference in CIE1976 L*u*v display system, or may obtain a color difference using a color difference formula defined in CIE2000. The distributed brightness calculation unit 222 may obtain the color difference based on lightness difference, chroma difference, and hue difference in an L*C*h display system. The distributed brightness calculation unit 222 may obtain a color difference which is specialized to the flicker phenomenon, by performing weighted addition to obtained differences of various kinds, for example. The distributed brightness calculation unit 222 may obtain the evaluation value Hi related to the flicker strength, using an equation other than the equation (6). In order to perform the above calculation, the distributed brightness calculation unit 222 may include a conversion matrix 223 for converting the brightness in an RGB display system to that in other display system (for example, CIE1976 L*a*b* display system) (refer to FIG. 12).

Figure 18:
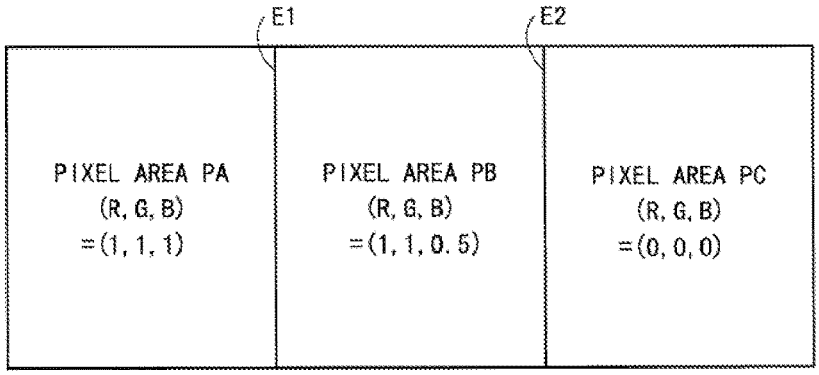
FIG. 18 is a diagram showing three adjacent pixel areas.
Figure 19:
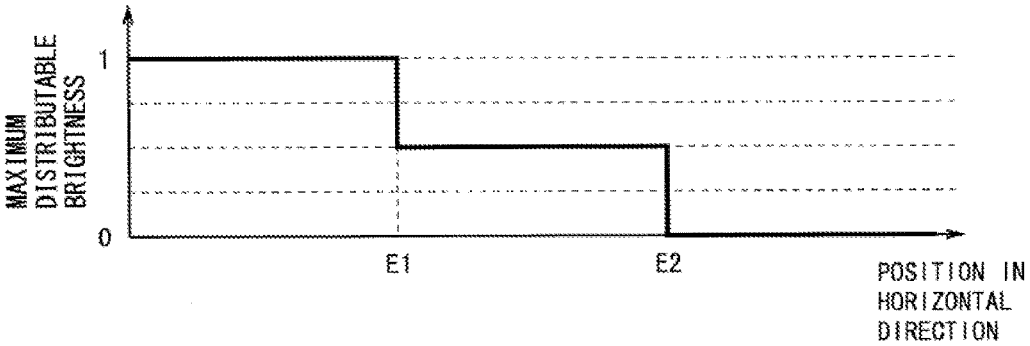
FIG. 19 is a diagram showing maximum distributable brightness of the pixel areas shown in FIG. 18.

Effects of the image display device according to the present embodiment will be described below referring to FIGS. 18 to 21. Three adjacent pixel areas PA, PB, PC as shown in FIG. 18 are considered here. Display colors of the pixel areas PA, PB are the same as those in the first embodiment. A display color of the pixel area PC is black and is represented by (R, G, B)=(0, 0, 0) using the color components. A boundary of the pixel areas PA, PB is referred to as an edge E1, and a boundary of the pixel areas PB, PC is referred to as an edge E2. In this case, the maximum distributable brightness is 1 in the left side of the edge E1, is 0.5 in the right side of the edge El and in the left side of the edge E2, and is 0 in the right side of the edge E2 (refer to FIG. 19). The distributable brightness range is from 0 to 1 in the left side of the edge E1, is from 0 to 0.5 in the right side of the edge E1 and in the left side of the edge E2, and is 0 in the right side of the edge E2. When an output brightness data is obtained based on the maximum distributable brightness in the distributable brightness range, the flicker phenomenon occurs near the edge E1, but does not occur near the edge E2. This is because even when the brightness difference of the white subframe is large at the edge portion of the display image, if the color difference is also large at the portion, the flicker phenomenon is hard to be recognized.

Figure 20:
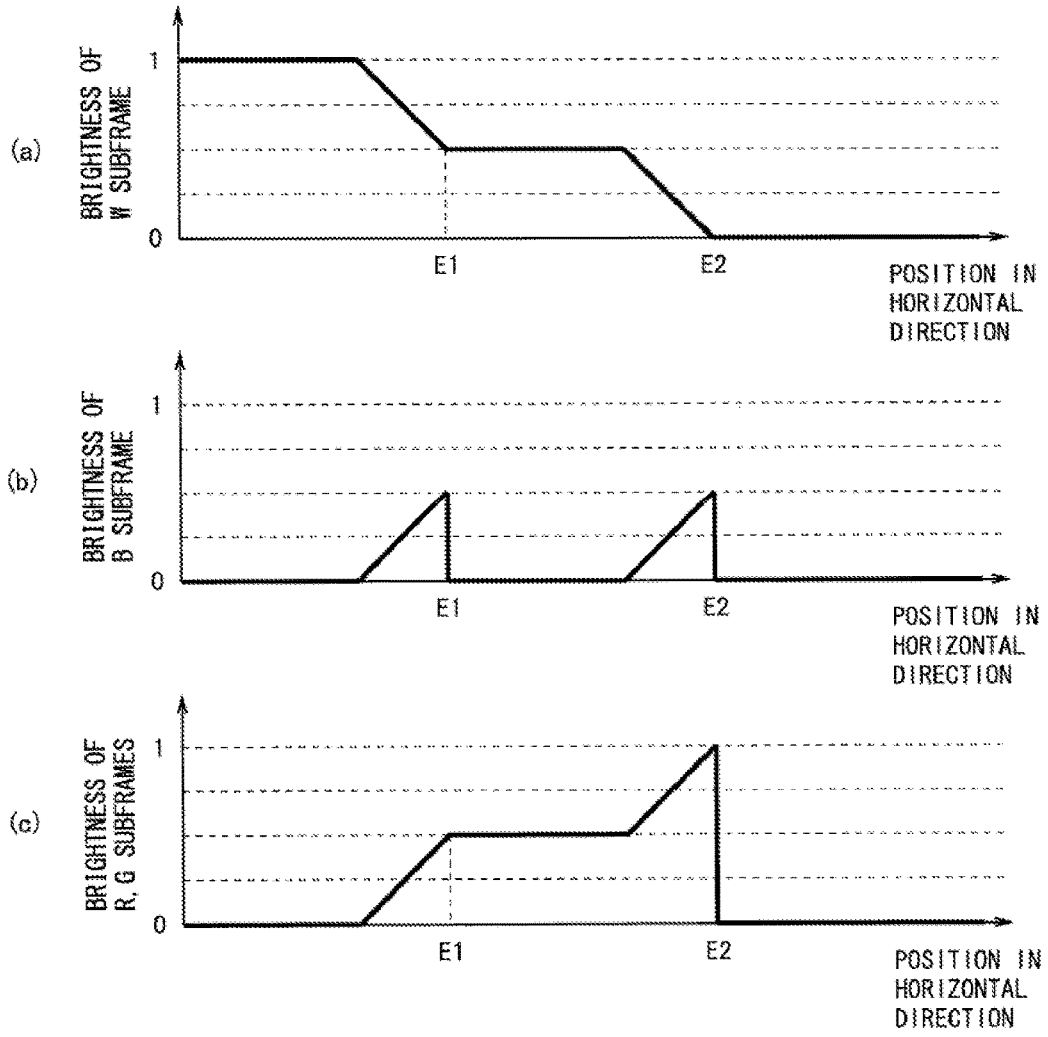
FIG. 20 is a diagram showing brightness in the image display device shown in FIG. 1.
Figure 21:
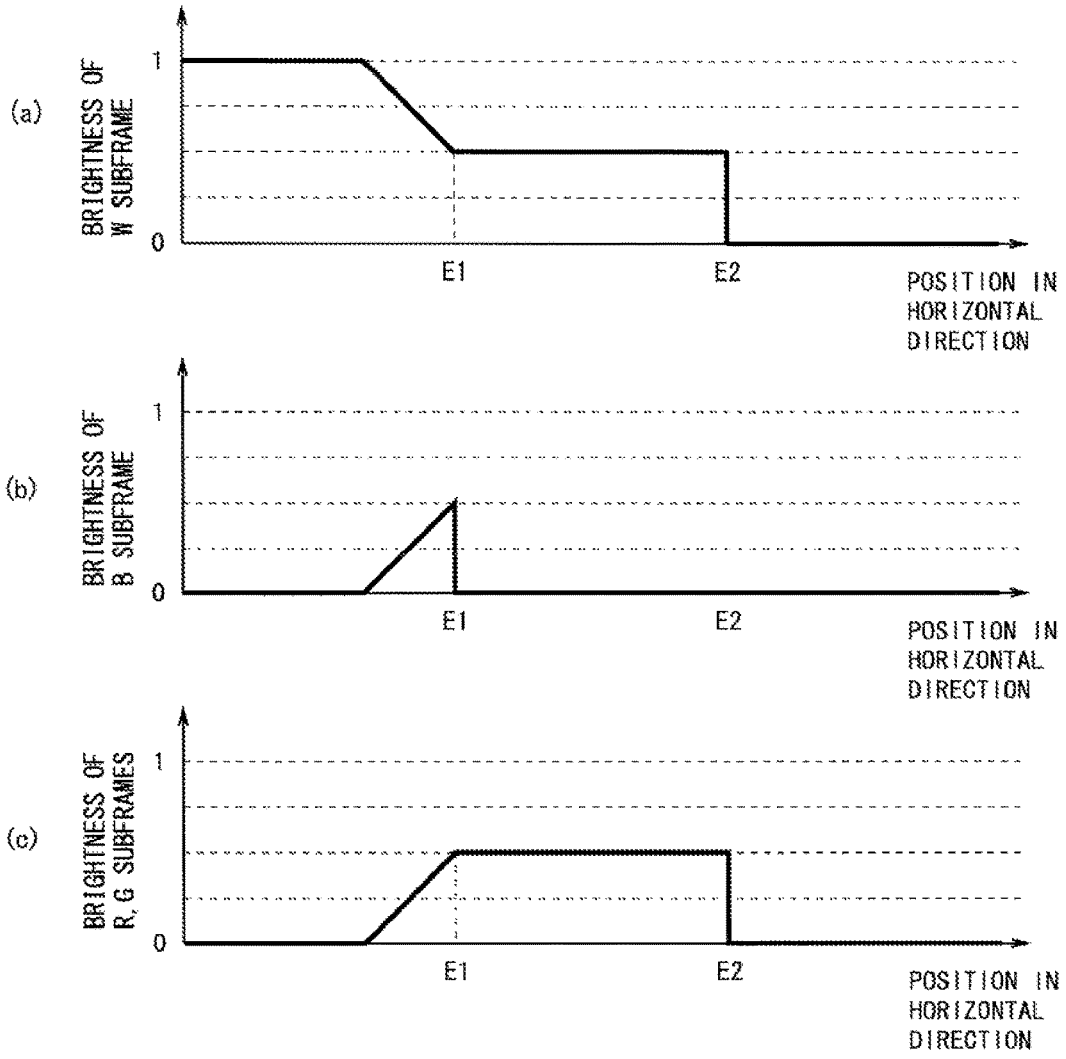
FIG. 21 is a diagram showing brightness in the image display device according to the second embodiment of the present invention.

In the image display device according to the first embodiment, brightness of each subframe is determined as shown in FIG. 20 (*a*) to (*c*) in accordance with a position in the horizontal direction. On the contrary, the image display device according to the present embodiments obtains the evaluation value related to the flicker strength, and reduces the brightness difference of the adjacent pixels in the white subframe when the flicker strength is large. In the image display device according to the present embodiment, the brightness of each subframe is determined as shown in FIG. 21 (*a*) to (*c*) in accordance with the position of the horizontal direction.

In this manner, the image display device according to the present embodiment reduces the distributed brightness only in a portion where the flicker phenomenon occurs, and suppresses the flicker phenomenon. Therefore, compared to the image display device according to the first embodiment, it is possible to increase the brightness of the white subframe at a portion where the flicker phenomenon does not occur, and suppresses the color breakup. Furthermore, compared to the image display device according to the first embodiment, it is possible to reduce a range in which the brightness of the white subframe changes and suppress the color shift effectively.

As described above, in the image display device according to the present embodiment, the subframe data generation unit 22 obtains, with regard to each pixel, the evaluation value related to the flicker strength based on the brightness of the pixel and the brightness of the neighboring pixels, and performs adjustment processing based on the evaluation value. Therefore, according to the image display device of the present embodiment, as with the first embodiment, by bringing the distributed brightness of the pixel dose to the distributed brightness of the neighboring pixel, it is possible to reduce the difference between the distributed brightness of the adjacent pixels while preventing the color breakup, and suppress the flicker phenomenon occurring at the edge portion of the display image. Furthermore, it is possible to suppress the flicker phenomenon in a place where the flicker phenomenon occurs and reduce the color breakup in a place where the flicker phenomenon does not occur, by performing the adjustment processing based on the evaluation value related to the flicker strength.

Furthermore, the subframe data generation unit 22 performs, with respect to each pixel P as the adjustment processing, processing tier setting the value Qi to (Dsp−Dsi)×Hi×Fi when Dsp is not less than Dsi, setting the value Qi to 0 otherwise, and subtracting the maximum value of Qi from Dsp, when Dsp is the maximum value that the distributed brightness of the pixel P can take, Dsi is the maximum value that the distributed brightness of the neighboring pixel Pi can take, Fi is the coefficient related to the neighboring pixel Pi, and Hi is the evaluation value related to the neighboring pixel Pi. It is possible to reduce the difference between the distributed brightness of the adjacent pixels only in a portion where the flicker phenomenon occurs, by thus bringing the distributed brightness of the pixel close to the distributed brightness of the neighboring pixel based on the evaluation value related to the flicker strength.

Note that as the evaluation value Hi related to the flicker strength, an evaluation value calculated using a value obtained by applying a low-pass filter to the brightness of each color of the neighboring pixels considering visual characteristics may be used. Furthermore, the evaluation value Hi may not relate to color difference, so long as it represents the flicker strength. Furthermore, when a pixel size is small, the flicker phenomenon is not recognized per one pixel. Thus, a degree (for example several pixels) to which pixels having a target color are gathered may be determined in accordance with a resolution of the display screen, a visual distance (distance between the display screen and the observer), and the like, and the evaluation value Hi related to the flicker strength may be obtained.

Furthermore, the distributed brightness calculation unit 222 may obtain an evaluation value related to a color breakup strength in addition to the evaluation value Hi related to the flicker strength, after obtaining the integrated brightness when the line of sight moves and when the line of sight is fixed. In this case, it is preferable that the distributed brightness calculation unit 222 have a priority setting parameter which defines either the flicker phenomenon or the color breakup is preferentially suppressed based on the two kinds of the evaluation value. The priority setting parameter is data having a plurality of bits and specifies in a stepwise manner either the flicker phenomenon or the color breakup is preferentially suppressed. According to the image display device, an image can be displayed with setting in a stepwise manner either the flicker phenomenon or the color breakup is preferentially suppressed.

(Third Embodiment)

An image display device according to a third embodiment of the present invention has the same configuration as that of the image display device according to the second embodiment. The distributed brightness calculation unit 222 of the image display device according to the present embodiment obtains the distributed brightness so as to avoid a gradation with which the color shift (phenomenon in which a display color is shifted) occurs easily. In the liquid crystal display device performing the field-sequential drive, the color shift occurs when a difference from supposed brightness is large due to as slow response speed of liquid crystal. Especially, when a color to be displayed includes a high gradation component or a low gradation component, the color shift occurs easily, because the response of the liquid crystal is slow as the characteristics of a liquid crystal mode in the high gradation and in the low gradation, or a correction of response of the liquid crystal is difficult in many cases.

The image display devices according to the first and second embodiments suppress the flicker phenomenon by changing the brightness of the white subframe when displaying the same color. However, since different gradations are used when displaying the same color, the color shift occurs in some cases depending on the response speed of the liquid crystal.

On the contrary, the distributed brightness calculation unit 222 of the image display device according to the present embodiment obtains the distributed brightness (brightness of the white subframe) based on the response speed of the liquid crystal so as to avoid the gradation with which the color shift occurs easily. Specifically, the distributed brightness calculation unit 222 obtains the distributed brightness of the selected pixel P by the same method as the second embodiment, performs processing on the obtained distributed brightness for moving the brightness Ewp, Erp, Egp, Ebp of four colors of the selected pixel P obtained by the output brightness calculation unit 123 in a predetermined range (hereinafter referred to as "move the output brightness in a target range"), and outputs the distributed brightness data Dt including the obtained distributed brightness. With this, the color shift can be prevented. Note that the distributed brightness calculation unit 222 obtains the distributed brightness by a predetermined method when the output brightness can not be moved in the target range.

The processing for moving the output brightness in the target range in the image display device according to the present embodiment will be described below referring to FIGS. 22 to 24. Hereinafter, a lower limit value of the target range of the output brightness is denoted by L1, an upper limit value thereof is denoted by L2, the minimum value of the brightness Drp, Dgp, Dbp of three colors of the selected pixel P is denoted by M1, the maximum value thereof (equals to the maximum distributable brightness Dsp) is denoted by M2, distributed brightness of the selected pixel P before processing is denoted by Dtp, and distributed brightness of the selected pixel P after processing is denoted by DTp. In this case, $0 \le L1 \le L2 \le 1$ and $0 \le M1 \le M2 \le 1$ are satisfied. When a value of L2 is determined to be small in this case, the color breakup suppressing effect is degraded. Thus, it is preferable to determine the value of L2 to be not less than a predetermined value. Thus, $L2 \ge 0.5$ here.

Figure 22:
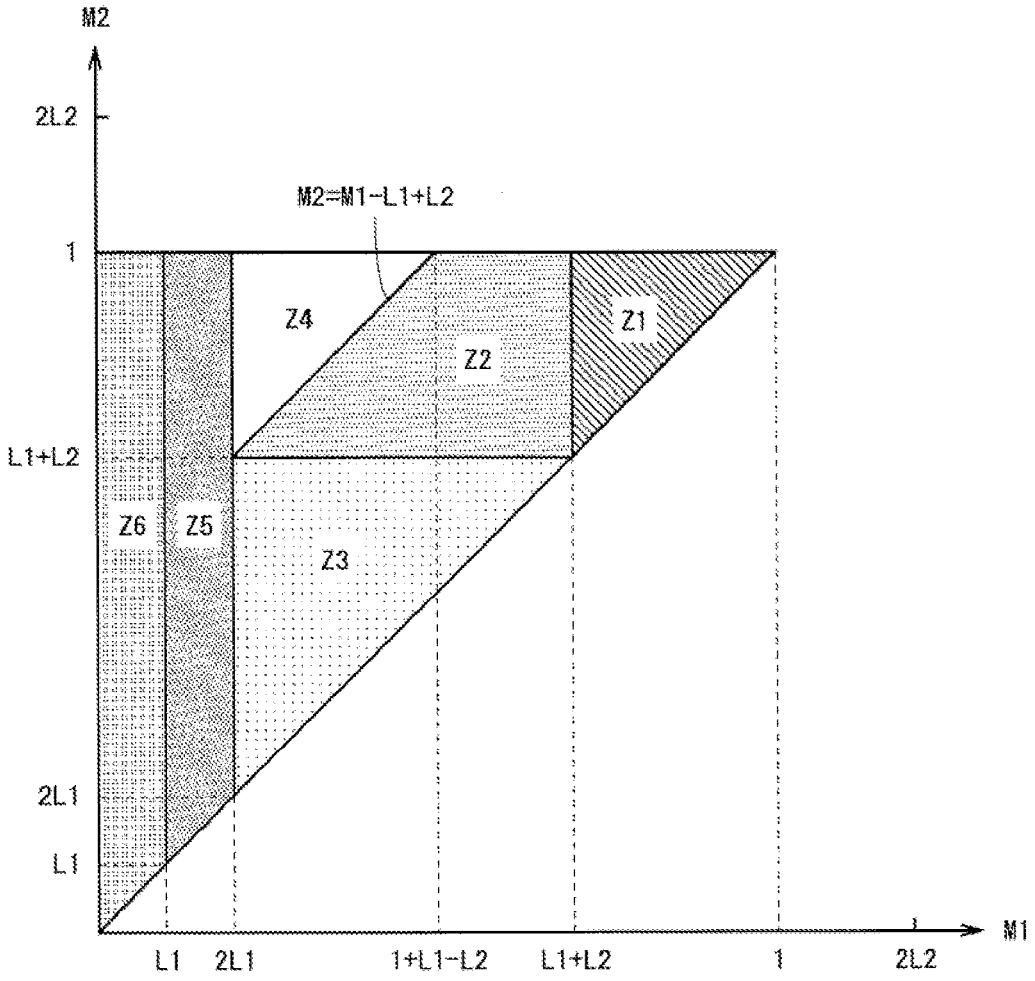
FIG. 22 is a diagram showing an area division in a distributed brightness calculation unit of an image display device according to a third embodiment of the present invention.

A range in which $0 \le M1 \le M2 \le 1$ is satisfied is divided into six ranges Z1 to Z6 shown in FIG. 22. The distributed brightness calculation unit 222 determines a range in which a given pair of M1 and M2 is included from among the ranges Z1 to Z6, and performs processing in accordance with the result. When the pair of M1 and M2 is included in one of the ranges Z1 to Z3, the output brightness can be moved in the target range by adjusting the distributed brightness Dtp. When the pair of M1 and M2 is included in one of the ranges Z4 to Z6, the output brightness can not be moved in the target range, even if the distributed brightness Dtp is adjusted.

(a) when included in the range Z1 (when $M1 \ge L1+L2$)

In this case, the output brightness can be moved in the target range by setting the distributed brightness Dtp to a value not less than (M2−L2) and not more than L2. Therefore, the distributed brightness calculation unit 222 obtains DTp as follows: DTp=lim(M2−L2, Dtp, L2). Here, lim(a, x, b) is a function for limiting x in a range from a to b, that is, a function which returns a when x is not more than a, returns b when x is not less than b, and returns x otherwise.

(b) when included in the range Z2 (when $M1 < L1+L2 \le M2$ and $M2 \le M1-L1+L2$)

In this case, the output brightness can be moved in the target range by setting the distributed brightness Dtp to a value not less than (M2−L2) and not more than (M1−L1). Therefore, the distributed brightness calculation unit 222 obtains DTp as follows: DTp=lim(M2−L2, Dtp, M1−L1).

(c) when included in the range Z3 (when $M1 \ge 2L1$ and $M2 < L1+L2$)

In this case, the output brightness can be moved in the target range by setting the distributed brightness Dtp to a value not less than L1 and not more than (M1−L1). Therefore, the distributed brightness calculation unit 222 obtains DTp as follows: DTp=lim(L1, Dtp, M1−L1).

(d) when included in the range Z4 (when $M1 \ge 2L1$ and $M2 > M1-L1+L2$)

In this case, the output brightness can not be moved in the target range even if the distributed brightness Dtp is adjusted. Thus, the distributed brightness calculation unit 222 obtains DTp as follows: DTp=M1−L1.

(e) when included in the range Z5 (when $L1 \ge M1 < 2L1$)

In this case, the output brightness can not be moved in the target range even if the distributed brightness Dtp is adjusted. Thus, the distributed brightness calculation unit 222 obtains the distribution brightness DTp after processing in accordance with the following equation (7).

$$DTp = M1(1-K3) - L1(1-2\times K3) \quad (7)$$

In the equation (7), K3 is a coefficient not less than 0 and not more than 1. The distributed brightness DTp after processing becomes larger, as the coefficient K3 becomes larger.

(f) when included in the range Z6 (when M1<L1)

In this case, the output brightness can not be moved in the target range even if the distributed brightness Dtp is adjusted. Thus, the distributed brightness calculation unit 222 obtains Dip as follows: DTp=M1×K3.

Figure 23:
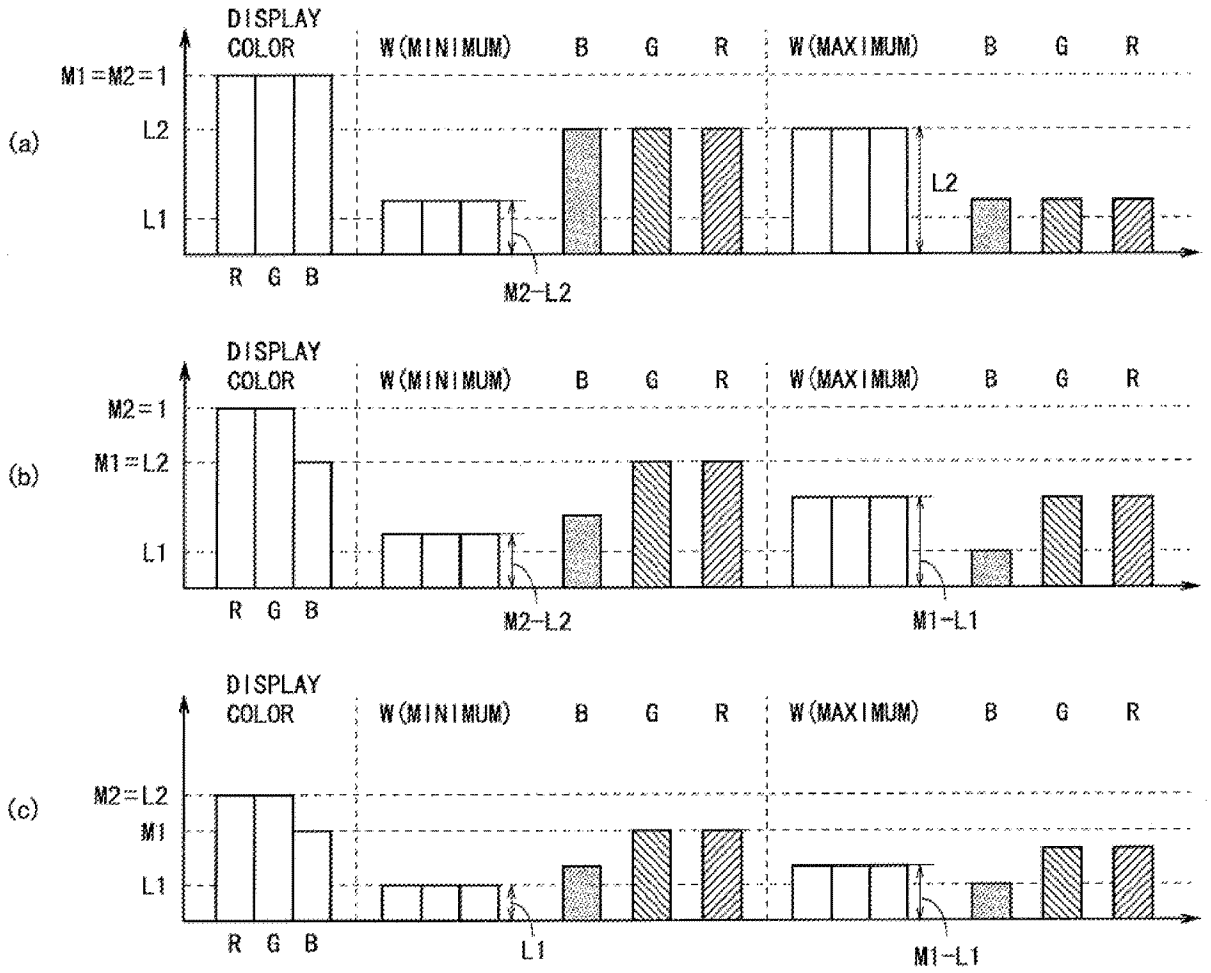
FIG. 23 is a diagram showing a distribution method of brightness in the image display device according to the third embodiment of the present invention.
Figure 24:
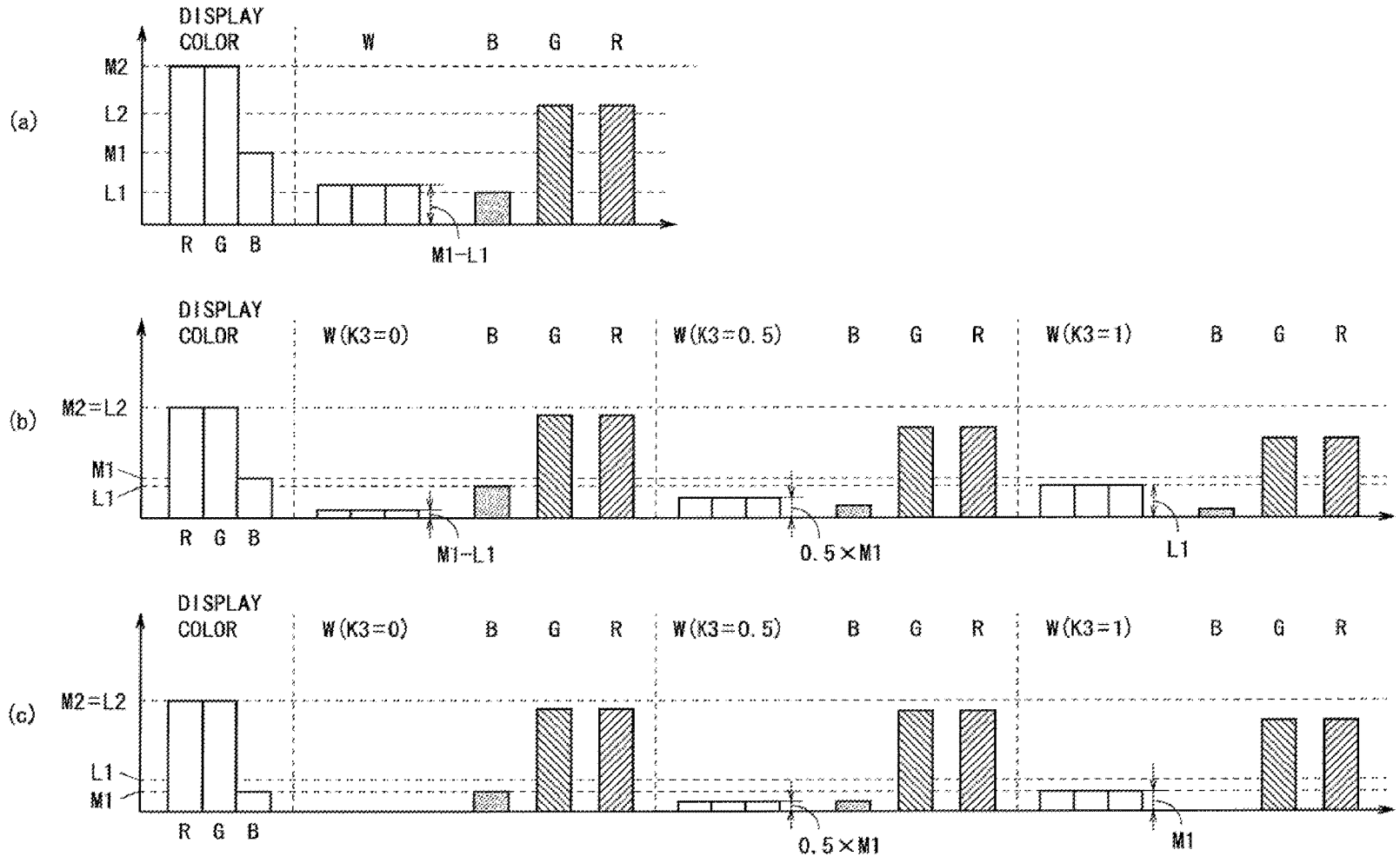
FIG. 24 is a diagram showing the distribution method of brightness in the image display device according to the third embodiment of the present invention.

FIGS. 23 and 24 are diagrams showing a distribution method of brightness in the image display device according to the present embodiment. In a case shown in FIG. 23(*a*), the pair of M1 and M2 is included in the range Z1. In this case, the distributed brightness DTp is adjusted to a value not less than (M2−L2) and not more than L2. In a case shown in FIG. 23(*b*), the pair of M1 and M2 is included in the range Z2. In this case, the distributed brightness DTp is adjusted to a value not less than (M2−L2) and not more than (M1−L1). In a case shown in FIG. 23(*c*), the pair of M1 and M2 is included in the range Z3. In this case, the distributed brightness DTp is adjusted to a value not less than L1 and not more than (M1−L1). In a case shown in FIG. 24(*a*), the pair of M1 and M2 is included in the range Z4. In this case, the distributed brightness DTp is set to (M1−L1). In a case shown in FIG. 24(*b*), the pair of M1 and M2 is included in the range Z5. In this case, the distributed brightness DTp is set to a value not less than (M1−L1) and not more than L1 in accordance with the coefficient K3. In a case shown in FIG. 24(*c*), the pair of M1 and M2 is included in the range Z6. In this case, the distributed brightness DTp is set to a value not less than 0 and not more than M1 in accordance with the coefficient K3.

Figure 25:
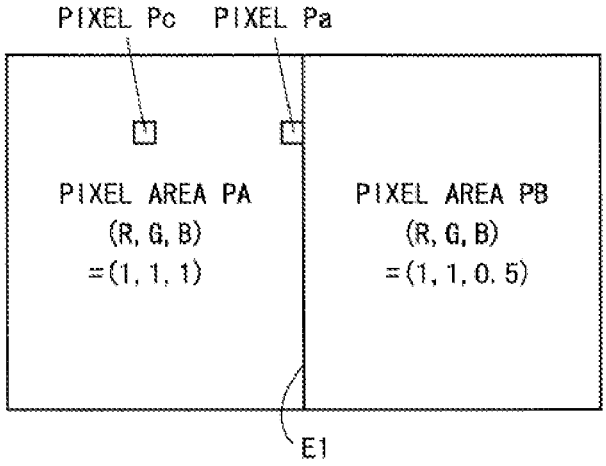
FIG. 25 is a diagram showing two adjacent pixel areas.

An operation example of the image display device according to the present embodiment will be described below referring to FIGS. 25 to 28. As an example, two adjacent pixel areas PA, PB shown in FIG. 25 are considered here. Display colors of the pixel areas PA, PB are the same as those in the first embodiment. A boundary of the pixel areas PA, PB is referred to as an edge E1, a pixel immediately left to the edge E1 is referred to as Pa, and a pixel which is in the left side of the edge E1 and in a position apart from the edge E1 is referred to as Pc.

Figure 26:
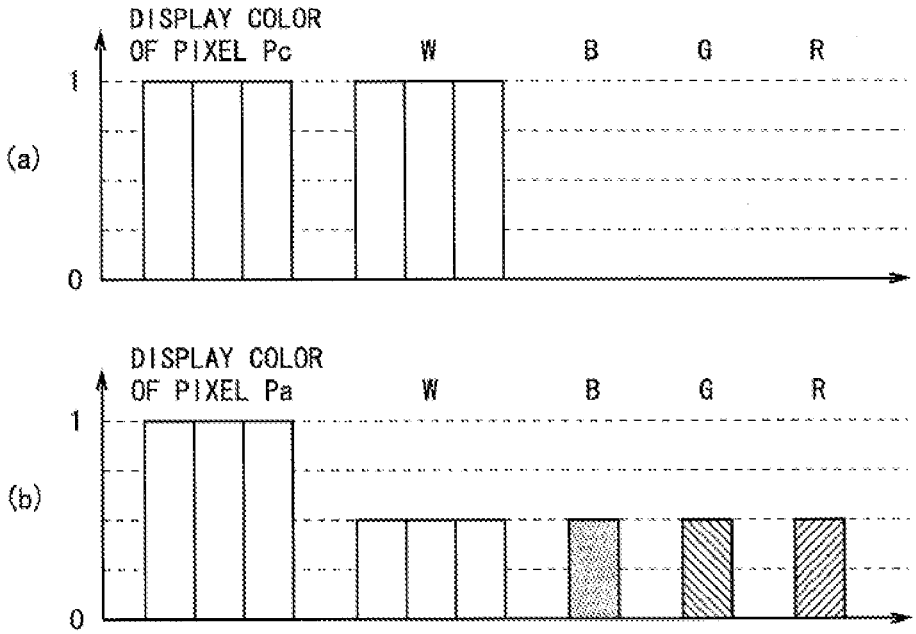
FIG. 26 is a diagram showing a distribution method of brightness in the image display device shown in FIG. 1.

In the image display devices according to the first and second embodiments, the brightness of the pixel Pc in the white subframe is determined to be 1, and accordingly the brightness of the pixel Pc in the blue, green, and red subframes is determined to be 0 (FIG. 26(*a*)). The brightness of the pixel Pa in the white subframe is determined to be 0.5, and accordingly the brightness of the pixel Pa in the blue, green, and red subframe is determined to be 0.5 (FIG. 26(*b*)). The brightness of the subframes is determined as shown in FIG. 11(*a*) to (*c*), in accordance with a position in the horizontal direction.

Figure 27:
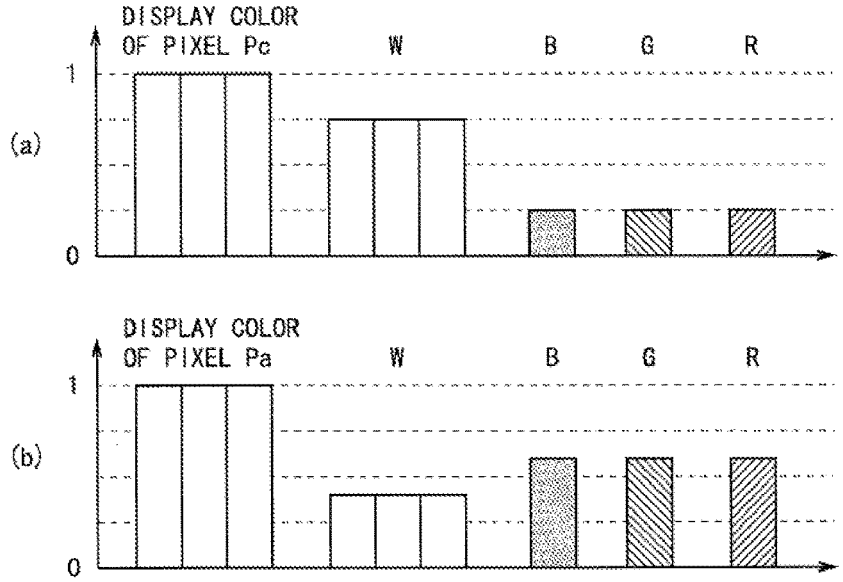
FIG. 27 is a diagram showing a distribution method of brightness in the image display device according to the third embodiment of the present invention.
Figure 28:
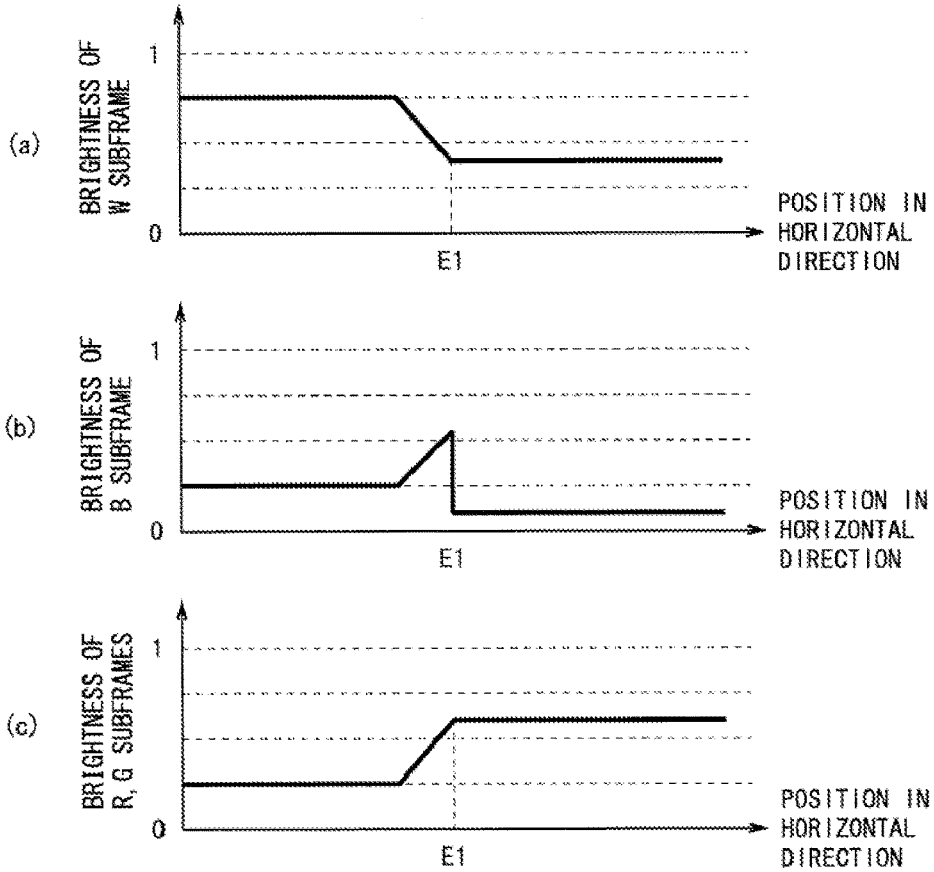
FIG. 28 is a diagram showing brightness in the image display device according to the third embodiment of the present invention.

In the image display device according to the present embodiment, differently from the first and second embodiments, the brightness of the pixel Pa in the white subframe is determined to be 0.4, and accordingly the brightness of the pixel Pa in the blue, green, and red subframes is determined to be 0.6 (FIG. 27(*b*)). The brightness of the pixel Pc in the white subframe is determined to be 0.75, and accordingly the brightness of the pixel Pc in the blue, green, and red subframes is determined to be 0.25 (FIG. 27(*a*)). The brightness of each subframe is determined as shown in FIG. 28(*a*) to (*c*), in accordance with the position in the horizontal direction.

For the pixel Pc, the image display devices according to the first and second embodiments use a high gradation corresponding to brightness 1 in the white subframe, and use a low gradation corresponding to brightness 0 in the blue, green, and red subframes. Thus, the color shift occurs more easily in the pixel Pc than in the pixel Pa. On the other hand, for the pixel Pc, the image display device according to the present embodiment uses a gradation corresponding to brightness 0.75 in the white subframe, and uses a gradation corresponding to brightness 0.2 in the blue, green, and red subframes. It is possible to prevent the color shift between the pixels Pa, Pc by thus avoiding the high gradation corresponding to brightness I and the low gradation corresponding to brightness 0.

As described above, in the image display device according to the present embodiment, the subframe data generation unit performs processing on the distributed brightness for moving the output brightness data in the predetermined target range. Therefore, according to the image display device of the present embodiment, it is possible to prevent using the high gradation and the low gradation with which the color shift occurs easily and prevent the color shift.

(Fourth Embodiment)

Figure 29:
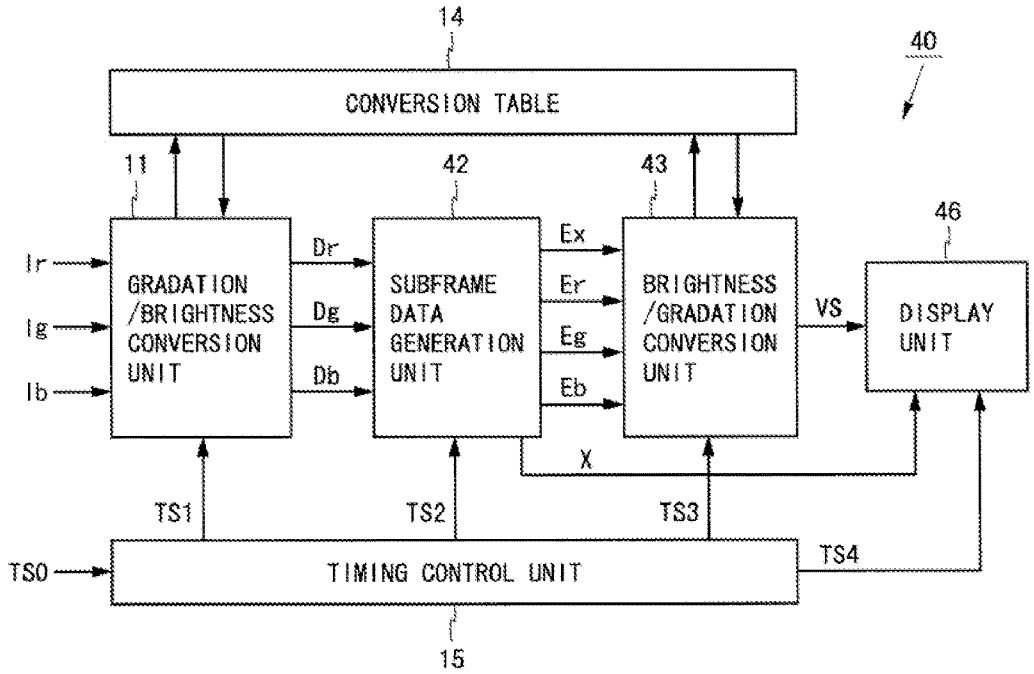
FIG. 29 is a block diagram showing a configuration of an image display device according to a fourth embodiment of the present invention.

FIG. 29 is a block diagram showing a configuration of an image display device according to a fourth embodiment of the present invention. An image display device 40 shown in FIG. 29 includes the gradation/brightness conversion unit 11, a subframe data generation unit 42, a brightness/gradation conversion unit 43, the conversion table 14, the timing control unit 15, and a display unit 46. Of the components of the present embodiment, the same components as those of the first embodiment are provided with the same reference numerals and their descriptions are omitted.

The image display device 40 is a field-sequential image display device for displaying four subframes in one frame period. The image display device 40 has a function of selecting a color of the first subframe from among red, green, blue, white, cyan, magenta, and yellow. Brightness of each pixel in the first subframe can be determined within a range from 0 to a minimum value of one, two, or three brightness of red, green, and blue. Hereinafter, a color of the first subframe is referred to as a distribution color X. The image display device 40 displays subframes of the distribution color X, blue, green, and red in one frame period.

The subframe data generation unit 42 generates output brightness data corresponding to the subframe of four colors based on input brightness data corresponding to the color components of three colors. The output brightness data represents brightness of each pixel. The subframe data generation unit 42 determines one distribution color X from among red, green, blue, white, cyan, magenta, and yellow for an entire display screen based on brightness data Dr, Dg, Db of three colors, and generates brightness data Ex, Er, Eg, Eb of four colors.

The brightness/gradation conversion unit 43 performs gamma conversion to convert the output brightness data to output gradation data. The output gradation data represents gradation of each pixel. The brightness/gradation conversion unit 43 converts the brightness data Ex, Er, Eg, Eb of four colors respectively to display gradation data (display gradation data of the distribution color X, red green, and, blue) of four colors, and outputs the video signal VS including the display gradation data of four colors. The display unit 46 performs the field-sequential drive based on the video signal VS, the timing control signal TS4, and the distribution color X to display four subframe in one frame period.

Figure 30:
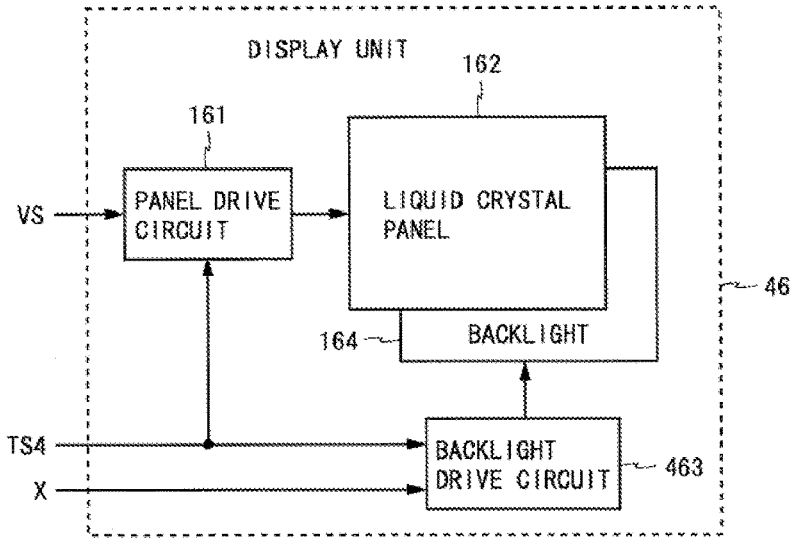
FIG. 30 is a block diagram showing a detail of a display unit shown in FIG. 29.

FIG. 30 is a block diagram showing a detail of the display unit 46. The display unit 46 shown in FIG. 30 is obtained by replacing the backlight drive circuit 163 of the display unit 16 (FIG. 2) according to the first embodiment with a backlight drive circuit 463. In each subframe period, the backlight drive circuit 463 causes the light source(s) to emit light in accordance with the color of the subframe based on the timing control signal TS4 and the distribution color X. Specifically, the backlight drive circuit 463 causes the blue light source to emit light in the second subframe period, causes the green light source to emit light in the third subframe period, and causes the red light source to emit light in the fourth subframe period. In the first subframe period, the backlight drive circuit 463 causes the red light source to emit light when the distribution color X is red, causes the green light source to emit light when the distribution color X is green, causes the blue light source to emit light when the distribution color X is blue, causes the red, green, and blue light sources to emit light when the distribution color X is white, cause the green and blue light sources to emit light when the distribution color X is cyan, causes the red and blue light sources to emit light when the distribution color X is magenta, and causes the red and green light sources to emit light when the distribution color X is yellow. With this, the subframes of the distribution color X, blue, green, and red are displayed sequentially on the liquid crystal panel 162 in one frame period. As described, the display unit 46 switches the color of the variable color subframe for the entire display screen. Note that, as with the first embodiment, the configuration of the display unit 46 is not limited to the configuration shown in FIG. 30.

Figure 31:
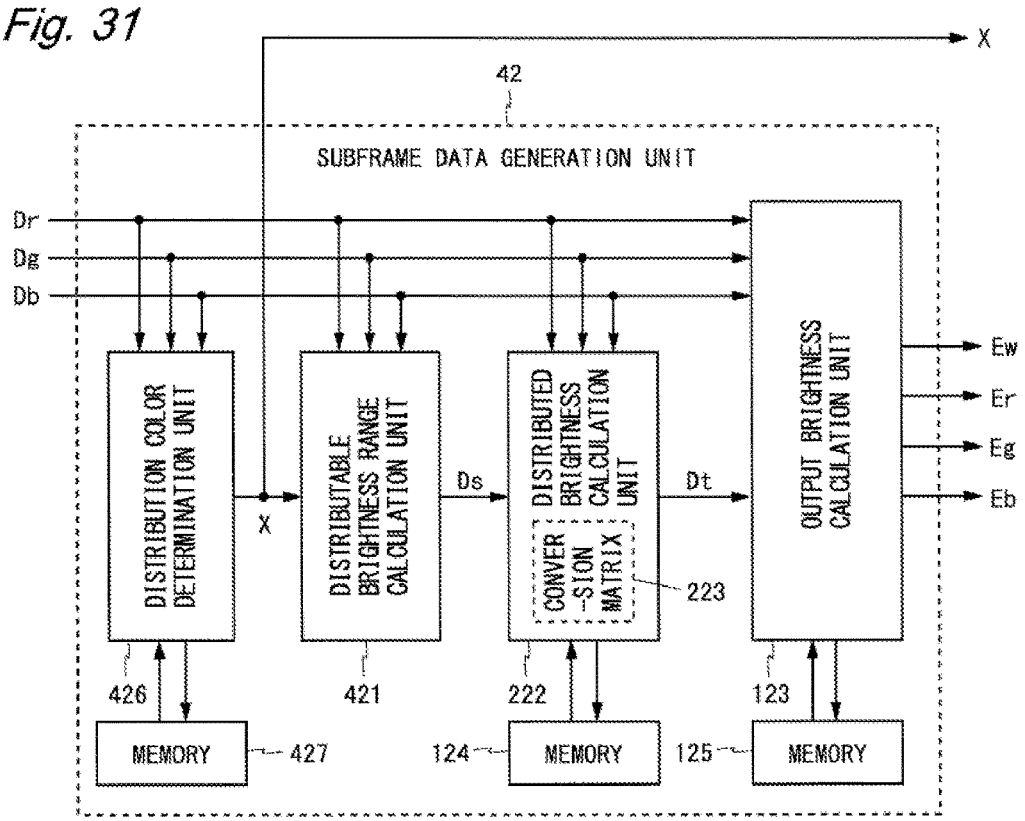
FIG. 31 is a block diagram showing a detail of a subframe data generation unit shown in FIG. 29.

FIG. 31 is a block diagram showing, a detail of the subframe data generation unit 42. The subframe data generation unit 42 is obtained based on the subframe data generation unit 22 (FIG. 12) according to the second embodiment by replacing the distributable brightness range calculation unit 121 with a distributable brightness range calculation unit 421 and adding a distribution color determination unit 426 and a memory 427. The memory 427 is a working memory of the distribution color determination unit 426.

The distribution color determination unit 426 determines one distribution color X for the entire the display screen based on the input brightness data. For example, the distribution color determination unit 426 calculates the number of data close to white. the number of data close to cyan, the number of data close to magenta, and the number of data close to yellow included in the input brightness data, and determines the distribution color X to be a color corresponding to the maximum number in the counted numbers (first method). The first method is a method for determining distribution color X, considering that the color breakup is to be suppressed preferentially.

Alternatively, the distribution color determination unit 426 may determine the distribution color X by the following method, considering the flicker phenomenon occurring at the edge portion of the display image (second method). When a screen is displayed using the first method, the flicker phenomenon may occur depending on a combination of a color of a pixel and colors of surrounding pixels. For example, when the distribution color X is determined to be white in a case where many combinations of white and yellow are included in the display screen, the flicker phenomenon may occur near a boundary of two pixel areas and an image quality may degrade. Thus, in the second method, when many combinations of colors of pixels with which the flicker phenomenon occurs are included in the display screen, the distribution color X is determined to be a color different from that determined by the first method. For example, the distribution color determination unit 426 determines the distribution color X to be yellow when there are many combinations of white and yellow, determines the distribution color X to be green when there are many combinations of white and green, and determines the distribution color X to be cyan when there are many combinations of white and cyan. The reason for this is that the flicker phenomenon is strongly recognized in the combination of white and yellow, the combination of white and green, and the combination of white and cyan. According to the second method, it is possible to suppress the color breakup to some extent while suppressing the flicker phenomenon.

Alternatively, the distribution color determination unit 426 may evaluate a degree that the flicker phenomenon is recognized, based on the brightness of the pixel and the brightness of the neighboring pixels, and may determine the distribution color X in accordance with the evaluation result (third method). The distribution color determination unit 426 may determine the distribution color X by an arbitrary method, not limited to the above-described first to third methods.

With regard to each pixel included in the input brightness data, the distributable brightness range calculation unit 421 obtains a minimum value of one, two or three data in accordance with the distribution color X from among the brightness data Dr, Dg, Db of three colors as the maximum distributable brightness, and outputs the distributable brightness range data Ds including the obtained maximum distributable brightness. Specifically, the distributable brightness range calculation unit 421 obtains the red brightness data Dr when the distribution color X is red, obtains the green brightness data Dg when the distribution color X is green, and obtains the blue brightness data Db when the distribution color X is blue. When the distribution color X is white, the distributable brightness range calculation unit 421 obtains the minimum value of the brightness data Dr, Dg, Db of three colors. When the distribution color X is cyan, the distributable brightness range calculation unit 421 obtains the minimum value of the brightness data Dg, Db of two colors. When the distribution color X is magenta, the distributable brightness range calculation unit 421 obtains the minimum value of the brightness data Dr, Db, of two colors. When the distribution color X is yellow, the distributable brightness range calculation unit 421 obtains the minimum value of the brightness data Dr, Dg of two colors. The distributable brightness range calculation unit 421 outputs the distributable brightness range data Ds including the obtained minimum value as the maximum distributable brightness.

As described above, in the image display device 40 according to the present embodiment, the plurality of subframes (first to fourth subframes) includes the variable color subframe (first sublime) of which color is selectable, and the subframe data generation unit 42 determines the color of the variable color subframe (distribution color X) based on the input brightness data Dr, Dg, Db. Therefore, according to the image display device 40 of the present embodiment, it is possible to suppress the flicker phenomenon occurring at the edge portion of the display image while preventing the color breakup in the field-sequential image display device in which the color of the subframe is selectable.

Note that although in the above description the distributed brightness is obtained for the first subframe which is a variable color subframe, a target subframe for obtaining the distributed brightness may be arbitrarily selected from among the plurality of subframes (here, first to fourth subframes). Especially, it is preferable to select, as the target subframe for obtaining the distributed brightness, a subframe having many colors common to the subframes of input colors or the remaining subframes (more distributable subframe), or a subframe having a probability that the flicker phenomenon becomes stronger if distributed.

Furthermore, although in the above description the color of the first subframe (variable color subframe) is selected from among red, green, blue, white, cyan, magenta, and yellow, the color of the variable color subframe may be determined to be an arbitrary color. In general, when the distribution color X is represented as X=(Xr, Xg, Xb) using the color components, the distributable brightness range calculation unit 421 selects the pixel sequentially, and obtains the maximum value of T that satisfies the following equations (8a) to (8c) as the maximum distributable brightness of the selected pixel P. In this case, in the first subframe period, the backlight drive circuit 463 causes the red light source to emit light at brightness in accordance with the red component Xr, causes the green light source to emit light at brightness in accordance with the green component Xg, and causes the blue light source to emit light at brightness in accordance with the blue component Xb.

$$Drp-Xr\times T\geq 0 \tag{8a}$$

$$Dgp-Xg\times T\geq 0 \tag{8b}$$

$$Dbp-Xb\times T\geq 0 \tag{8c}$$

In an image display device in which the color of the subframes (including the variable color subframe) is one of red, green, blue, white, cyan, magenta, and yellow, such as the image display device according to the first to fourth embodiments, each of the light sources of three kinds included in the backlight emits light at predetermined brightness (at sufficiently high brightness) or does not emit light in each subframe period. Therefore, the subframe data generation unit obtains the brightness data which does not depend on the brightness of the backlight, under a condition that the brightness of the backlight is fixed.

On the contrary, in an image display device in which the color of each subframe may be a color other than red, green, blue, white, cyan, magenta, and yellow, such as the image display device which arbitrarily determines the color of the variable color subframe, each of the light sources of three kinds included in the backlight may emit light at brightness lower than the above-described predetermined brightness in each subframe period. Therefore, it is necessary for the subframe data generation unit to obtain the brightness data in accordance with the brightness of the backlight, under a condition that the brightness of the backlight may change. The brightness data in accordance with the brightness of the backlight is a transmittance of the pixel, for example. In the following, for the purpose of description, it is assumed that the transmittance of the pixel is 1 when the pixel corresponds to the maximum gradation, and is 0 when the pixel corresponds to the minimum, gradation. A usage example of the transmittance of the pixel will be described in a variant of the fourth embodiment that follows.

(Variant of Fourth Embodiment)

Figure 32:
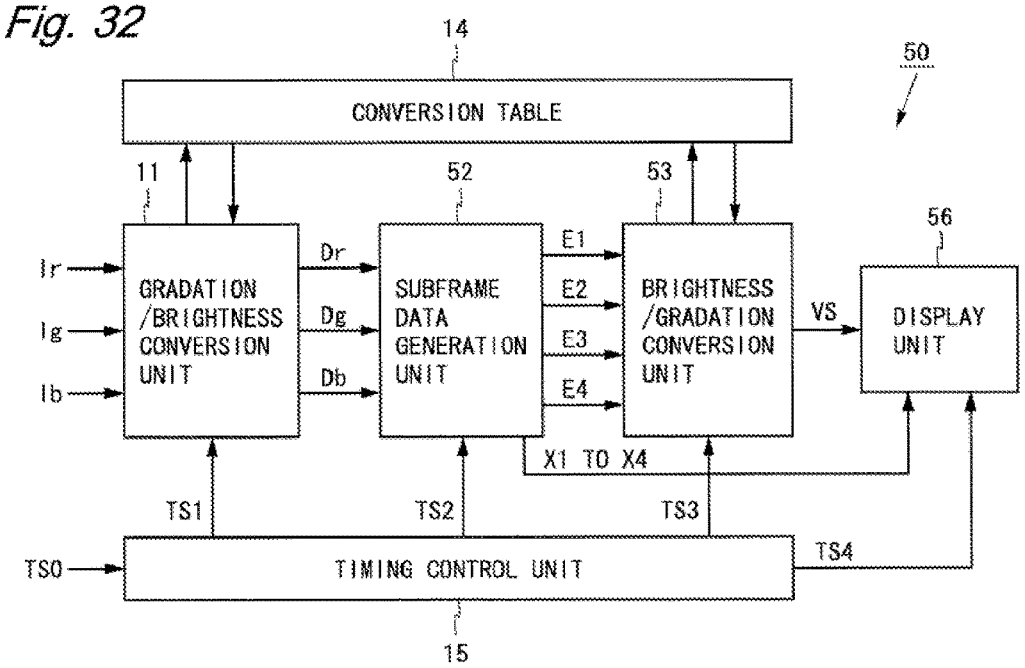
FIG. 32 is a block diagram showing a configuration of an image display device according to a variant of the fourth embodiment of the present invention.

FIG. 32 is a block diagram showing a configuration of an image display device according to a variant of the fourth embodiment of the present invention. An image display device 50 shown in FIG. 32 includes the gradation/brightness conversion unit 11, a subframe data generation unit 52 (FIG. 33), a brightness/gradation conversion unit 53, the conversion table 14, the timing control unit 15, and a display unit 56 (FIG. 34). The image display device 50 hast function of setting colors of all subframes to arbitrary colors. In the following, colors of the first to fourth subframes are denoted by X1 to X4, respectively.

Figure 33:
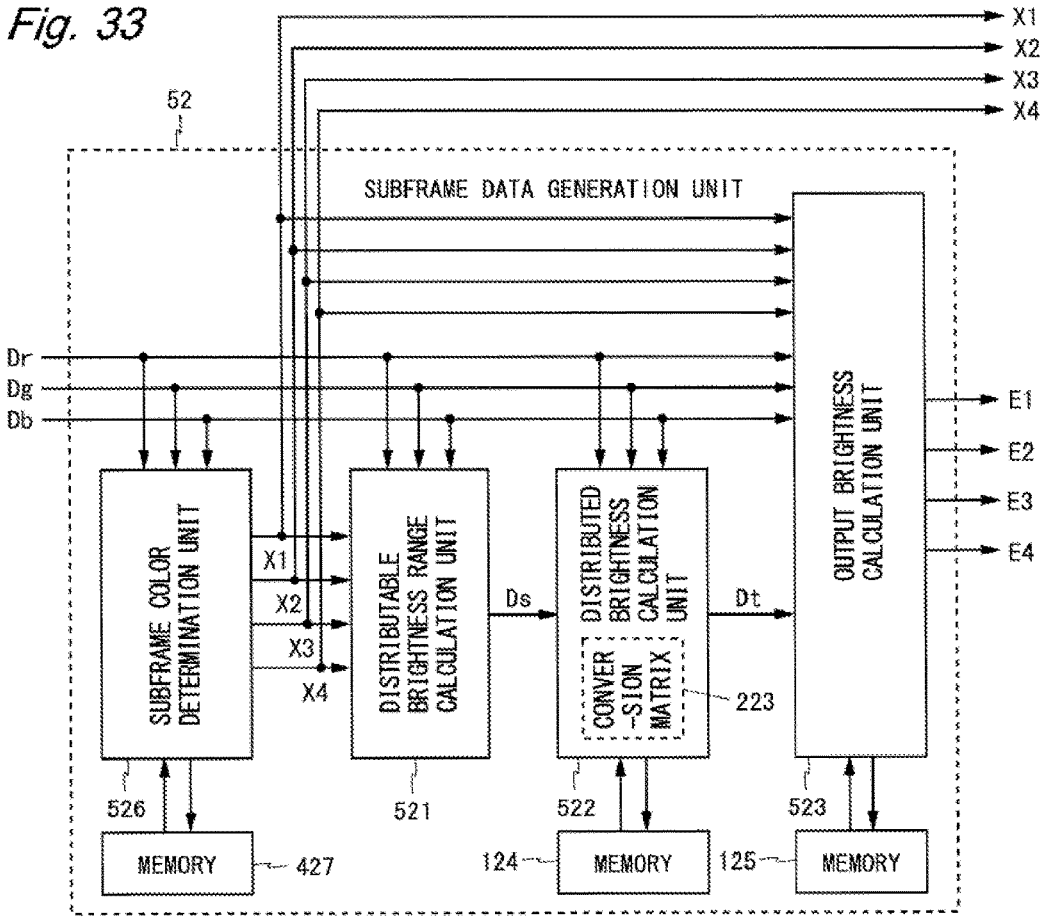
FIG. 33 is a block diagram showing a detail of a subframe data generation unit shown in FIG. 32.
Figure 34:
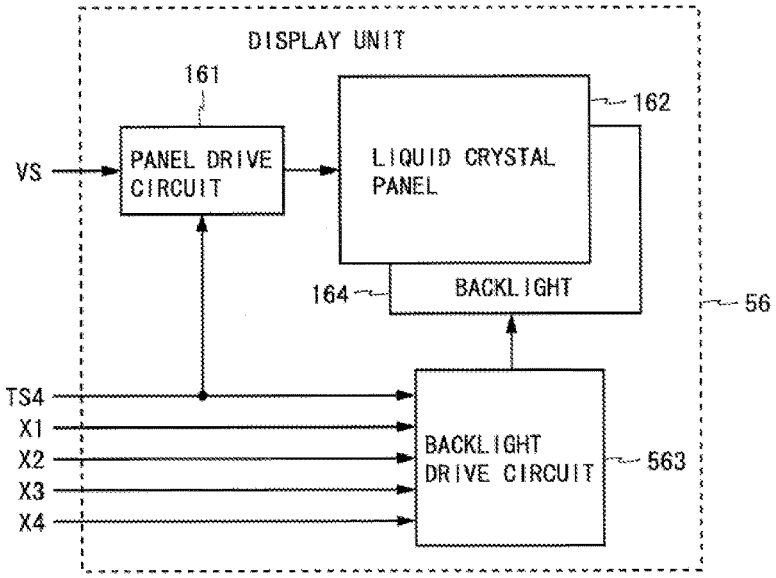
FIG. 34 is a block diagram showing a detail of a display unit shown in FIG. 32.

As shown in FIG. 33, the subframe data generation unit 52 includes a subframe color determination unit 526, a distributable brightness range calculation unit 521, a distributed brightness calculation unit 522, an output brightness calculation unit 523, and memories 124, 125, 427. The subframe color determination unit 526 obtains a set of the colors X1 to X4 of the first to fourth subframes for the entire display screen based on the input brightness data. The method for determining the colors X1 to X4 of the first to fourth subframes may be arbitrary. It is assumed below that the colors X1 to X4 of the first to fourth subframes are represented by the following equations (9a) to (9d) using the color components.

$$X1=(X1r, X1g, X1b) \tag{9a}$$

$$X2=(X2r, X2g, X2b) \tag{9b}$$

$$X3=(X3r, X3g, X3b) \tag{9c}$$

$$X4=(X4r, X4g, X4b) \tag{9d}$$

Figure 35:
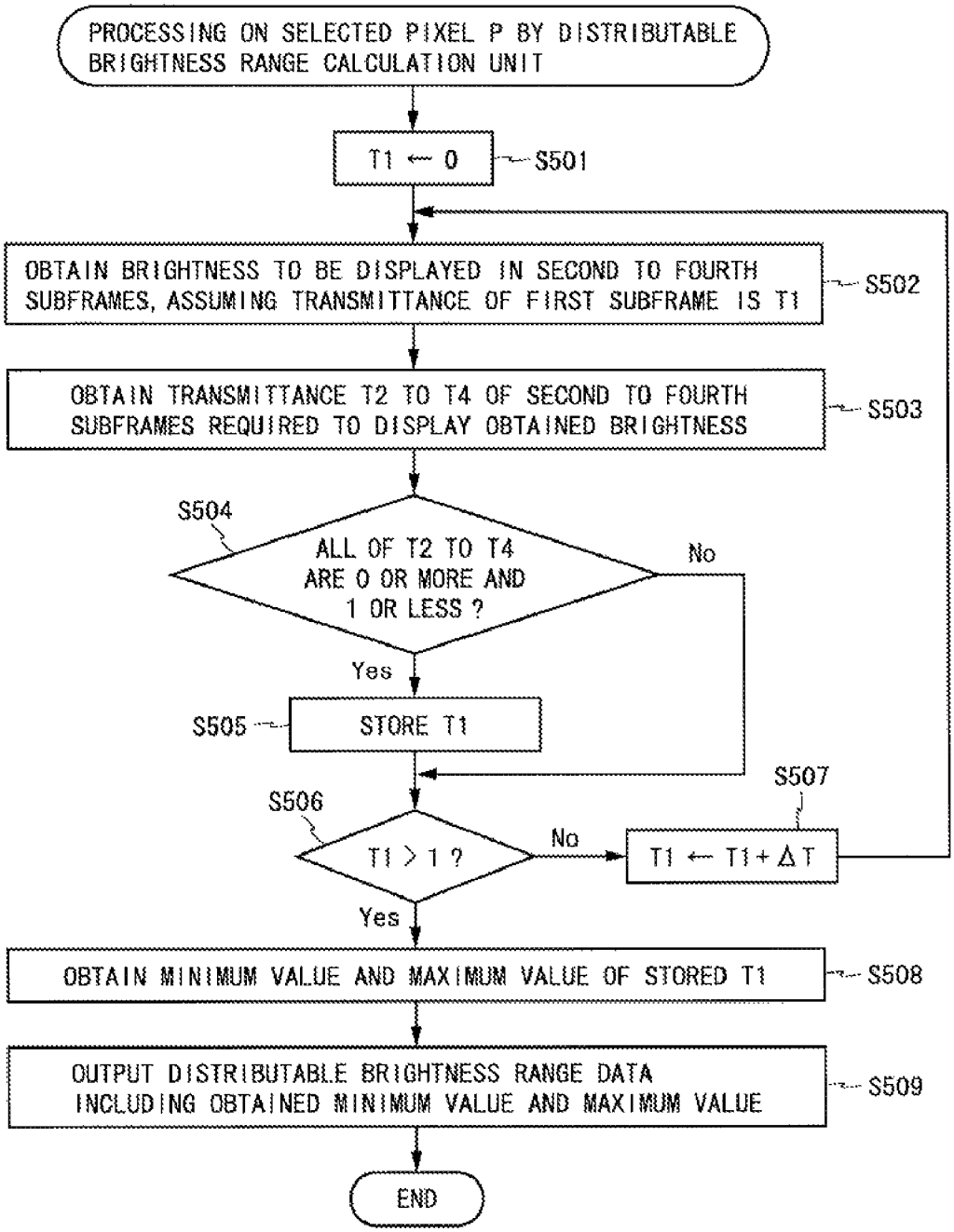
FIG. 35 is a flowchart showing processing of a distributable brightness range calculation unit of the image display device shown in FIG. 32.

The distributable brightness range calculation unit 521 obtains the distributable brightness range data Ds based on the brightness data Dr, Dg, Db of three colors and the colors X1 to X4 of the first to fourth subframes obtained by the subframe color determination unit 526. FIG. 35 is a flowchart showing processing of the distributable brightness range calculation unit 521. The distributable brightness range calculation unit 521 selects pixels sequentially, and performs processing shown in FIG. 35 on the selected pixel P. Hereinafter, the brightness of three colors of the selected pixel P is denoted by Drp, Dgp, Dbp, and transmittance of the first to fourth subframes is denoted by T1 to T4, respectively.

At first, the distributable brightness range calculation unit 521 sets the transmittance T1 of the first subframe to 0 (step S501). After that, the distributable brightness range calculation unit 521 performs steps S502 to S507 repeatedly until Yes is determined in step S506.

In step S502, the distributable brightness range calculation unit 521 obtains the brightness to be displayed in the second to fourth subframes, assuming that the transmittance of the first subframe is T1 (step S502). Specifically, the distributable brightness range calculation unit 521 obtains a red component Crp, a green component Cgp, and a blue component Cbp of the brightness to be displayed in the second to fourth subframe, in accordance with the following equations (10a) to (10c).

$$Crp=Drp-X1r\times T1 \tag{10a}$$

$$Cgp=Dgp-X1g\times T1 \tag{10b}$$

$$Cbp=Dbp-X1b\times T1 \tag{10c}$$

Next, the distributable brightness range calculation unit 521 obtains the transmittance T2 to T4 of the second to fourth subframes required to display the brightness obtained in step S502 (step S503). Specifically, the distributable brightness range calculation unit 521 obtains the three pieces of transmittance T2 to T4 by solving simultaneous liner equations in three variables shown in the following equations (11a) to (11c).

$$Crp=X2r\times T2+X3r\times T3+X4r\times T4 \tag{11a}$$

$$Cgp=X2g\times T2+X3g\times T3+X4g\times T4 \tag{11b}$$

$$Cbp=X2b\times T2+X3b\times T3+X4b\times T4 \tag{11c}$$

Next, the distributable brightness range calculation unit 521 determines whether an of the three transmittance T2 to T4 obtained in step S503 are 0 or more and 1 or less (step S504). When Yes is determined in step S504, the distributable brightness range calculation unit 521 stores the transmittance T1 of the first subframe (step S505), and goes to step S506. When No is determined in step S504, the distributable brightness range calculation unit 521 goes to step S506 without performing step S505.

In step S506, the distributable brightness range calculation unit 521 determines whether the transmittance T1 of the first subframe exceeds 1. When No is determined in step S506, the distributable brightness range calculation unit 521 adds a predetermined value ΔT ($0<\Delta T<1$) to the transmittance T1 of the first subframe step S507), and goes to step S502.

When Yes is determined in step S506, the distributable brightness range calculation unit 521 obtains the minimum value and the maximum value of the transmittance T1 of the first subframe stored in step S505 (step S508). Next, the distributable brightness range calculation unit 521 outputs the distributable brightness range data Ds including the minimum value and the maximum value obtained in step S508 (step S509).

As with the distributed brightness calculation unit 222, the distributed brightness calculation unit 522 obtains the evaluation value related to the flicker strength, and obtains the distributed brightness using the obtained evaluation value. In addition to this, the distributed brightness calculation unit 522 performs processing for limiting the obtained distributed brightness in a range from the minimum value to the maximum value included in the distributable brightness range data Ds. The distributed brightness calculation unit 522 outputs the distributed brightness data Dt including the distributed brightness after processing.

The output brightness calculation unit 523 generates the output brightness data based on the input brightness data, the distributed brightness data Dt obtained by the distributed brightness calculation unit 522, and the colors X1 to X4 of the first to fourth subframes obtained by the subframe color determination unit 526. Hereinafter, the distributed brightness of the selected pixel P obtained by the distributed brightness calculation unit 522 is denoted by Dtp.

The output brightness calculation unit 523 obtains the red component Crp, the green component Cgp, and the blue component Cbp of brightness to be displayed in the second to fourth subframes, by setting the transmittance T1*p* of the first subframe of the selected pixel P to Dtp and substituting Dtp to T1 in the equations (10a) to (10c). Next, the output brightness calculation unit 523 obtains the transmittance T2*p* to T4*p* of the second to fourth subframes of the selected pixel P, by solving simultaneous linear equations in three variables shown in the equations (11a) to (11c) for T2 to T4 and setting T2 to T4 to T2*p* to T4*p*. The subframe data generation unit 52 outputs the brightness data E1, E2, E3, E4 including the transmittance T1*p* to T4*p* of the first to fourth subframes of the selected pixel P.

Note that the distributable brightness range calculation unit 521 may store the transmittance T1 to T4 of the first to fourth subframes in step S505. In this case, it is possible for the output brightness calculation unit 523 to obtain the transmittance T2*p* to T4*p* of the second to fourth subframes of the selected pixel P by selecting the transmittance T1*p* corresponding to the transmittance of the first subframe of the selected pixel P from among the stored transmittance without performing the above calculation.

The brightness/gradation conversion unit 53 converts the brightness data E1, E2, E3, E4 of four colors to the display gradation data (display gradation data of the colors X1, X2, X3, and X4) of four colors respectively, and outputs the video signal VS including the display gradation data of four colors.

As shown in FIG. 34, the display unit 56 is obtained by replacing the backlight drive circuit 463 in the display unit 46 with a backlight drive circuit 563. The first to fourth subframe colors X1 to X4 are supplied from the subframe color determination unit 526 to the display unit 56. In each subframe period, the backlight drive circuit 563 causes the light sources of three kinds to emit light at designated brightness based on the timing control signal TS and the color of each subframe. Specifically, in the first subframe period, based on the first subframe color X1=(X1*r*, X1*g*, X1*b*), the backlight drive circuit 563 causes the red light source to emit light at brightness in accordance with the data X1*r*, causes the green light source to emit light at brightness in accordance with the data X1*g*, and causes the blue light source to emit light at brightness in accordance with the data X1*b*. The backlight drive circuit 563 operates in a similar manner in the second to fourth subframe periods. Thus, subframes of the colors X1, X2, X3, X4 are sequentially displayed on the liquid crystal panel 162 in one frame period.

According to the image display device 50 of the present variant, in order to suppress the flicker phenomenon and the color breakup and reduce power consumption by causing the light sources with which the color breakup and the flicker phenomenon can be suppressed and which are minimum required to display the image, to emit light among the light sources of three kinds included in the backlight 164, as a result, power consumption of the image display device can be reduced.

(Fifth Embodiment)

An image display device according a fifth embodiment of the present invention has the same configuration as that of the image display device according to the second embodiment. However, the subframe data generation unit 22 performs different processing on the selected pixel P in the present embodiment and the second embodiment. Differences from the second embodiment will be described below.

Figure 36:
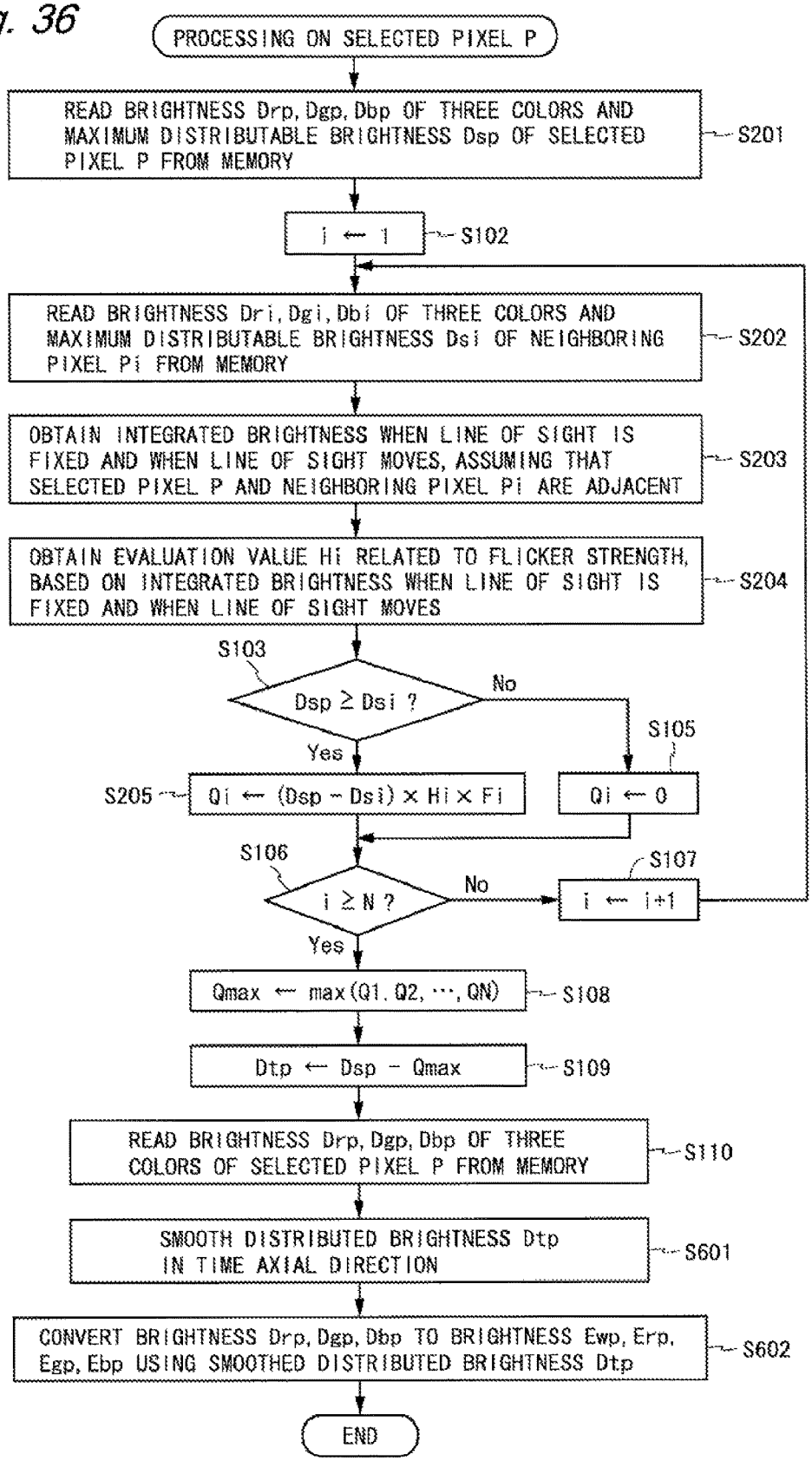
FIG. 36 is a flowchart showing processing performed on a selected pixel in an image display device according to a fifth embodiment of the present invention.

FIG. 36 is a flowchart showing processing performed on the selected pixel P by the subframe data generation unit 22 according to the present embodiment. The flowchart shown in FIG. 36 is obtained based on the flowchart shown in FIG. 13 by adding step S601 and replacing step S111 with step S602.

Processing before step S110 is the same as that: in the second embodiment. Before step S601 is performed, the memory 125 stores the distributed brightness Dtp of the selected pixel P obtained for k frames (k is an integer not less than 1) in the past. In step S601, the output brightness calculation unit 123 smooths the distributed brightness Dtp in a time axial direction, based on the distributed brightness Dtp of the selected pixel P obtained in step S109 and the distributed brightness Dtp of the selected pixel P obtained for the k frames in the past and stored in the memory 125. Next, the output brightness calculation unit 123 converts the brightness Drp, Dgp, Dbp of three colors of the selected pixel P to the brightness Ewp, Erp, Egp, Ebp of four colors using the smoothed distributed brightness Dtp (step S602). Specifically, the output brightness calculation unit 123 performs calculation shown in the above-described equations (2a) to (2d) using the smoothed distributed brightness Dtp.

As described above, in the image display device according, to the present embodiment, the subframe data generation unit 22 smooths the distributed brightness in the time axial direction. Therefore, according to the image display device of the present embodiment, it is possible to prevent abrupt change of the distributed brightness and prevent degradation of image quality accompanied by abrupt shift of the display color.

In the above description, a feature that the distributed brightness is smoothed in the time axial direction is added to the image display device according to the second embodiment. The feature that the distributed brightness is smoothed in the time axial direction may be added to the image display devices according to any of the above-described embodiments and their variants.

(Variants of Each Embodiment)

As for the image display devices according to the embodiments of the present invention, the following variants can be constituted. The present invention is also applicable to an image display device that switches and performs a plurality of systems of field-sequential drive. The present invention is also applicable to an image display device in which the number of color components included in input video data is different from the number of subframes displayed in one frame period. The display order of subframes and a drive frequency (field rate) in the image display devices of the present invention are arbitrary.

In each of the above-described embodiments and their variants, the color of each subframe is specifically described, but these colors are merely examples. In the image display device according to the present invention, the color of each subframe may be arbitrary. Specifically, the color of each subframe may be a fixed color determined in advance, or may be a variable color determined in accordance with input image.

The present invention is applicable not only to an image display device in which a backlight turns on at fixed brightness for an entire screen in each subframe period, but also to an image display device for controlling brightness of the backlight in accordance with the video data for the entire screen in each subframe period, and to an image display device for locally controlling the brightness of the backlight in accordance with the input video data in each subframe period. It is possible to reduce power consumption of the image display device and reduce the color breakup by controlling the brightness of the backlight.

Other than the liquid crystal display device, the present invention is also applicable to an image display device for displaying gradation by time-division drive, such as a PDP (Plasma Display Panel). The present invention is also applicable to an image display device having a sub-pixel corresponding to a designated color component and driving the backlight in the field-sequential system. The present invention is applicable not only to an image display device having a display panel and a backlight, but also to a light emission type image display device. The present invention is also applicable to a field-sequential image display device obtained by combining the above systems arbitrarily. Furthermore, the present invention is applicable not only to an image display device which obtains the distributed brightness in one subframe included in the plurality of subframes, but also to an image display device which obtains the distributed brightness for two or more subframes included in the plurality of subframes.

When brightness data is input from the outside, the image display device of the present invention may not be provided with the gradation/brightness conversion unit for performing inverse-gamma conversion. The image display device of the present invention may include the gradation/brightness conversion unit between the distributable brightness range calculation unit and the distributed brightness calculation unit, and the distributable brightness range calculation unit may obtain distributable brightness range based on gradation data in place of brightness data. Alternatively, the image display device of the present invention may include the gradation/brightness conversion unit between the distributed brightness calculation unit and the output brightness calculation unit, and the distributable brightness range calculation unit and the distributed brightness calculation unit may perform calculation based on the gradation data in place of the brightness data. Flicker can be suppressed also by these image display devices. Furthermore, when the display unit has a linear (line shape) characteristics, the image display device of the present invention may not be provided with the brightness/gradation conversion unit for performing gamma conversion. Input video data for each subframe subjected to frame interpolation for suppressing the color breakup when displaying a moving image may be input to the image display device of the present invention. In this case, the image display device of the present invention may perform processing on video data corresponding to the subframes to be displayed. Input video data subjected to a frequency conversion by frame interpolation processing or the like may be input to the image display device of the present invention. Video data with lowered resolution, video data applied with a low-pass filter or the like, or some other data may be input to the image display device of the present invention in place of raw data (original video data).

In the image display device of the present invention, the format of video data input to the subframe data generation unit and the format of video data output from the subframe data generation unit may be arbitrary. In the image display device of the present invention, the range of neighboring pixels may be determined arbitrarily. For example, a pixel with a distance from the selected pixel (Euclidean distance or Manhattan distance) less than or equal to a predetermined distance may be used as the neighboring pixel. Alternatively, every pixel within the display image may be used as the neighboring pixel.

Furthermore, by arbitrarily combining the features of the above-described image display devices unless contrary to the nature thereof, it is possible to constitute an image display device having a plurality of the above-described features. For example, by combining the image display device according to the fourth embodiment with the features of the third embodiment, it is possible to constitute an image display device which determines the distribution color and determines the distributed brightness so that the gradation with which the color shift occurs easily is avoided.

INDUSTRIAL APPLICABILITY

The image display device of the present invention has a feature that the flicker phenomenon occurring at the edge portion of the display image can be suppressed, and is thus usable for various types of a field-sequential image display device, such a field-sequential liquid crystal display device.

DESCRIPTION OF REFERENCE CHARACTERS

10, 40, 50: Image Display Device
11: Gradation/Brightness Conversion Unit
12, 22, 42, 52: Subframe Data Generation Unit
13, 43, 53: Brightness/Gradation Conversion Unit

14: Conversion Table
15: Timing Control Unit
16, 46, 56: Display Unit
121, 421, 521: Distributable Brightness Range Calculation Unit
122, 222, 522: Distributed Brightness Calculation Unit
123, 523: Output Brightness Calculation Unit
124, 125, 427: Memory
161: Panel Drive Circuit
162: Liquid Crystal Panel
163, 463, 563: Backlight Drive Circuit
164: Backlight
223: Conversion Matrix
426: Distribution Color Determination Unit
526: Subframe Color Determination Unit

The invention claimed is:

1. A field-sequential image display device comprising:

a subframe data generation unit configured to generate output brightness data corresponding to a plurality of subframes based on input brightness data corresponding to a plurality of color components; and a display unit configured to display the plurality of subframes in one frame period in accordance with a video signal based on the output brightness data, wherein the subframe data generation unit is configured to generate the output brightness data by obtaining distributed brightness with regard to each pixel based on the input brightness data, the distributed brightness being brightness of one or more subframes included in the plurality of subframes, and obtaining brightness of remaining subframes included in the plurality of subframes with regard to each pixel based on the input brightness data and the distributed brightness, the subframe data generation unit is configured to obtain the distributed brightness by setting an initial value of the distributed brightness to a maximum value that the distributed brightness can take, and then performing adjustment processing for reducing a difference between the distributed brightness of adjacent pixels; and the subframe data generation unit is configured to perform, with regard to each pixel P as the adjustment processing, processing for setting a value Qi to (Dsp−Dsi)×Fi when Dsp is not less than Dsi, setting the value Qi to 0 otherwise, and subtracting a maximum value of Qi from Dsp, when Dsp is a maximum value that the distributed brightness of the pixel P can take, Dsi is a maximum value that the distributed brightness of a neighboring pixel Pi can take, and Fi is a coefficient related to the neighboring pixel Pi.

2. The image display device according to claim 1, wherein the coefficient Fi becomes smaller, as a distance between the pixel P and the neighboring pixel Pi becomes larger.

3. A field-sequential image display device comprising:

a subframe data generation unit configured to generate output brightness data corresponding to a plurality of subframes based on input brightness data corresponding to a plurality of color components; and a display unit configured to display the plurality of subframes in one frame period in accordance with a video signal based on the output brightness data, wherein the subframe data generation unit is configured to generate the output brightness data by obtaining distributed brightness with regard to each pixel based on the input brightness data, the distributed brightness being brightness of one or more subframes included in the plurality of subframes, and obtaining brightness of remaining subframes included in the plurality of subframes with regard to each pixel based on the input brightness data and the distributed brightness, the subframe data generation unit is configured to obtain the distributed brightness by setting an initial value of the distributed brightness to a maximum value that the distributed brightness can take, and then performing adjustment processing for reducing a difference between the distributed brightness of adjacent pixels; and the subframe data generation unit is configured to perform, as the adjustment processing, processing for applying a low-pass filter to a maximum value that the distributed brightness can take.

4. A field-sequential image display device comprising:

a subframe data generation unit configured to generate output brightness data corresponding to a plurality of subframes based on input brightness data corresponding to a plurality of color components; and a display unit configured to display the plurality of subframes in one frame period in accordance with a video signal based on the output brightness data, wherein the subframe data generation unit is configured to generate the output brightness data by obtaining distributed brightness with regard to each pixel based on the input brightness data, the distributed brightness being brightness of one or more subframes included in the plurality of subframes, and obtaining brightness of remaining subframes included in the plurality of subframes with regard to each pixel based on the input brightness data and the distributed brightness, and the subframe data generation unit is configured to obtain the distributed brightness by setting an initial value of the distributed brightness to a maximum value that the distributed brightness can take, and then performing adjustment processing for reducing a difference between the distributed brightness of adjacent pixels;

the subframe data generation unit is configured to obtain, with regard to each pixel, an evaluation value related to flicker strength based on brightness of the pixel and brightness of neighboring pixels, and perform the adjustment processing based on the evaluation value; and the subframe data generation unit is configured to perform, with regard to each pixel P as the adjustment processing, processing for setting a value Qi to (Dsp−Dsi)×Hi×Fi when Dsp is not less than Dsi, setting the value Qi to 0 otherwise, and subtracting a maximum value of Qi from Dsp, when Dsp is a maximum value that the distributed brightness of the pixel P can take, Dsi is a maximum value that the distributed brightness of a neighboring pixel Pi can take, Fi is a coefficient related to the neighboring pixel Pi, and Hi is the evaluation value related to the neighboring pixel Pi.

5. The image display device according to claim 4, wherein the coefficient Fi becomes smaller, as a distance between the pixel P and the neighboring pixel Pi becomes larger.

* * * * *